US010984747B2

(12) United States Patent
Tagawa et al.

(10) Patent No.: US 10,984,747 B2
(45) Date of Patent: Apr. 20, 2021

(54) ACTIVE MATRIX SUBSTRATE, DISPLAY DEVICE, AND DRIVE METHOD THEREFOR

(71) Applicant: Sharp Kabushiki Kaisha, Sakai (JP)

(72) Inventors: Akira Tagawa, Sakai (JP); Takuya Watanabe, Sakai (JP); Jun Nishimura, Sakai (JP); Yasuaki Iwase, Sakai (JP); Yohei Takeuchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/935,238

(22) Filed: Jul. 22, 2020

(65) Prior Publication Data

US 2021/0035519 A1 Feb. 4, 2021

Related U.S. Application Data

(60) Provisional application No. 62/879,552, filed on Jul. 29, 2019.

(51) Int. Cl.
*G09G 3/36* (2006.01)

(52) U.S. Cl.
CPC ..... *G09G 3/3688* (2013.01); *G09G 3/3677* (2013.01); *G09G 2310/021* (2013.01); *G09G 2310/0243* (2013.01); *G09G 2310/0297* (2013.01); *G09G 2310/08* (2013.01); *G09G 2330/021* (2013.01)

(58) Field of Classification Search
CPC ..... G09G 3/3688; G09G 3/3677; G09G 2310/021; G09G 2310/0243; G09G 2310/0297; G09G 2310/08; G09G 2330/021
See application file for complete search history.

(56) References Cited

U.S. PATENT DOCUMENTS

2019/0180689 A1* 6/2019 Chen ..... G09G 3/30
2019/0180708 A1* 6/2019 Hong ..... G09G 3/20
2020/0342823 A1* 10/2020 Wu ..... G09G 3/3607
2020/0342824 A1* 10/2020 Li ..... G09G 3/3685

FOREIGN PATENT DOCUMENTS

WO 2018/190245 A1 10/2018

* cited by examiner

*Primary Examiner* — Sejoon Ahn
(74) *Attorney, Agent, or Firm* — Keating & Bennett, LLP

(57) ABSTRACT

In a display device including an active matrix substrate in which a demultiplexing circuit is formed, a boost circuit, which generates a plurality of connection control signals respectively applied to gate terminals of a plurality of connection control transistors as switching elements configuring the demultiplexing circuit are respectively generated, is provided in the demultiplexing circuit. An internal node of each boost circuit is precharged via a transistor turned on by a boosted voltage of an internal node of another boost circuit, and thereafter, a voltage of the internal node of the boost circuit is boosted via a boost capacitor by a control signal applied to a demultiplexing circuit. The boosted voltage of the internal node is applied to a gate terminal of a connection control transistor as a connection control signal.

15 Claims, 14 Drawing Sheets

ACTIVE MATRIX SUBSTRATE, DISPLAY DEVICE, AND DRIVE METHOD THEREFOR

BACKGROUND OF INVENTION

Field of Invention

The present invention relates to an active matrix substrate, and more particularly, to an active matrix substrate including a demultiplexer for time-divisionally applying each data signal output from a source drive circuit to two or more data signal lines. Further, the present invention relates to a display device including the active matrix substrate and a drive method therefor.

Description of Related Art

A display device such as an active matrix type liquid crystal display device uses an active matrix substrate in which a plurality of data signal lines (also referred to as "source lines"), a plurality of scan signal lines (also referred to as "gate lines") intersecting the plurality of data signal lines, and a plurality of pixel formation portions arranged in a matrix along the plurality of data signal lines and the plurality of scan signal lines are formed. In some cases, the display device adopts a method (hereinafter, referred to as a "DEMUX method") of grouping a plurality of data signal lines in an active matrix substrate into a plurality of sets, each set including two or more data signal lines and applying data signals time-divisionally to the two or more data signal lines of each set.

In the DEMUX method, a plurality of demultiplexers respectively corresponding to the plurality of sets described above are used, and a source drive circuit outputs, to each demultiplexer, a signal (hereinafter, referred to as a "multiplexed data signal"), which is obtained by time-divisionally multiplexing two or more data signals to be applied to two or more data signal lines of the corresponding set. Each demultiplexer includes two or more switching elements, which are respectively connected to two or more data signal lines of a corresponding set. Each multiplexed data signal from a source drive circuit is applied to any of the two or more data signal lines via a switching element switched on among two or more switching elements in the corresponding demultiplexer, and the switching elements in the ON state in each demultiplexer are sequentially switched. A data signal is applied to each data signal line via a switching element when the switching element connected to the data signal line in the corresponding demultiplexer is turned on, and thereafter, when the switching element changes to an OFF state, an analog voltage as the data signal is held in a wire capacitor. By doing so, one of the plurality of scan signal lines is selected in a state where the analog voltage as the data signal is applied to or held in each data signal line, and thereby, a voltage of the data signal line is written as pixel data to a pixel formation portion connected to the selected scan signal line.

In the active matrix type display device of a DEMUX method described above, the demultiplexer is often formed integrally (monolithically) with the pixel formation portion on the active matrix substrate to narrow a picture-frame of a display unit and reduce the number of output terminals and a circuit amount of the source drive circuit (hereinafter, a DEMUX method of using the active matrix substrate in which the demultiplexer and the pixel formation portion are integrally formed in this manner is referred to as a "monolithic DEMUX method").

A thin film transistor (hereinafter, abbreviated as a "TFT") is used as a switching element in each pixel formation portion formed on an active matrix substrate, and an oxide semiconductor may be used instead of amorphous silicon or low temperature polysilicon that is used in the related art as a material of a channel layer of this TFT. A TFT in which a channel layer is formed of an oxide semiconductor (hereinafter, referred to as an "oxide semiconductor TFT") has an extremely small leakage current when turned off, and a display device with low power consumption can be realized by using the TFT. However, mobility of the oxide semiconductor is lower than mobility of low temperature polysilicon. Therefore, when an oxide semiconductor TFT is used for the display device of a monolithic DEMUX method, it is necessary to increase a size of a TFT that configure a demultiplexer, as compared with a case in which a TFT in which a channel layer is formed of low temperature polysilicon (hereinafter, referred to as a "LTPS-TFT") is used. Increasing the size of the TFT in the demultiplexer causes an increase in a picture-frame size and power consumption of the display panel. Further, depending on specifications of the display panel, it is difficult to realize the demultiplexer by using the oxide semiconductor TFT.

In contrast to this, Pamphlet of International Publication No. 2018/190245 proposes a configuration of using a boost circuit for increasing a voltage to be applied to a gate terminal of a TFT configuring a demultiplexer for the DEMUX method. With this configuration, it is possible to suppress an increase in picture-frame size and power consumption even in a display device of a monolithic DEMUX method using an oxide semiconductor TFT.

However, recently, higher resolution of a display image and an increase in display size in a display device of a DEMUX method are in progress. Therefore, there is a case in which the configuration proposed by the pamphlet of International Publication No. 2018/190245 cannot cope with the higher resolution of the display image and the increase in display size.

SUMMARY

Therefore, in a display device of a monolithic DEMUX method using a TFT in which a channel layer is formed of a material having a relatively low mobility, such as an oxide semiconductor, it is desirable to further reduce power consumption while suppressing an increase in picture-frame size.

(1) An active matrix substrate according to an embodiment of the present invention includes a plurality of data signal lines, a plurality of scan signal lines intersecting the plurality of data signal lines, a plurality of pixel formation portions arranged along the plurality of data signal lines and the plurality of scan signal lines, and a demultiplexing circuit that includes a plurality of demultiplexers respectively corresponding to a plurality of sets of data signal lines obtained by grouping the plurality of data signal lines, each set including two or more data signal lines and includes a plurality of input terminals respectively corresponding to the plurality of demultiplexers, in which each of the plurality of demultiplexers includes two or more connection control switching elements respectively corresponding to the two or more data signal lines in a corresponding set, first conduction terminals of the two or more connection control switching elements are all connected to corresponding input terminals, and second conduction terminals of the two or more connection control switching elements are respectively connected to the two or more data signal lines of the corresponding set in each of the plurality of demultiplexers, the demultiplexing circuit includes a plurality of boost circuits that generate connection control signals to be applied to control terminals of the connection control switching elements included in the plurality of demultiplexers, each of the plurality of boost circuits includes an internal node connected to a control terminal of a connection control switching element to which a connection control signal to be generated is applied, and a charging/discharging switching element for charging and discharging the internal node and is configured to boost a voltage applied to the internal node via the charging/discharging switching element and to apply, as the connection control signal, a boosted voltage of the internal node to the control terminal of the connection control switching element, and the demultiplexing circuit is configured such that, when a charging/discharging switching element in any of the plurality of boost circuits is in an ON state, a boosted voltage of an internal node in another boost circuit is applied to the control terminal of the charging/discharging switching element.

According to the configuration, if time-divisionally multiplexed signals (multiplexed data signals) are applied to the plurality of input terminals of the demultiplexing circuit on the active matrix substrate, the respective multiplexed data signals are applied to the plurality of data signal lines as a plurality of data signals demultiplexed by a demultiplexing circuit. At this time, connection control signals for turning on/off the two or more connection control switching elements in each demultiplexer are generated by a boost circuit, based on a control signal (hereinafter, referred to as a "demultiplexing control signal") applied to operate the demultiplexing circuit. That is, in each boost circuit, a voltage applied to an internal node is boosted by precharging the internal node via the charging/discharging switching element based on a demultiplexing control signal, and the boosted voltage of the internal node is applied to a control terminal of a connection control switching element to be switched on as a connection control signal. Here, a boosted voltage of an internal node in another boost circuit is applied to the control terminal of the charging/discharging switching element for precharging the internal node. Therefore, for example, even when a thin film transistor (TFT) having a channel layer formed of an oxide semiconductor is used as a charging/discharging switching element, a precharge voltage is increased as compared to the related art, and thus, it is possible to increase a boosted voltage of the internal node, that is, a voltage of a connection control signal, and to decrease on-resistance of a charging/discharging switching element. Thereby, in a display device of a monolithic DEMUX method using a TFT having a channel layer formed of a material with relatively low mobility, such as an oxide semiconductor, it is possible to reduce power consumption while suppressing an increase in picture-frame size as compared to the related art.

(2) An active matrix substrate according to an embodiment of the present invention includes the configuration of (1) described above, and the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and the active matrix substrate further includes two or more signal lines for respectively transmitting the same control signal to the two or more boost circuit groups.

(3) An active matrix substrate according to a certain embodiment of the present invention includes the configuration of (1) described above, and an internal node of one boost circuit of the plurality of boost circuits is connected to control terminals of two or more connection control switching elements to which the same connection control signal is applied among connection control switching elements in the plurality of demultiplexers.

(4) An active matrix substrate according to a certain embodiment of the present invention includes the configuration of (3) described above, and the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and the active matrix substrate further includes two or more signal lines for respectively transmitting the same control signal to the two or more boost circuit groups.

(5) An active matrix substrate according to a certain embodiment of the present invention includes the configuration of (1) described above, and each of the plurality of boost circuits further includes an initialization switching element for initializing a voltage of the internal node at an end time of each frame period, immediately before start of each frame period, or at an halt time of a drive of the plurality of data signal lines and a drive of the plurality of scan signal lines.

(6) An active matrix substrate according to a certain embodiment of the present invention includes the configuration of (5) described above, and the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and the active matrix substrate further includes two or more signal lines for respectively transmitting the same control signal to the two or more boost circuit groups.

(7) An active matrix substrate according to a certain embodiment of the present invention includes the configuration of (5) described above, and an internal node of one boost circuit of the plurality of boost circuits is connected to control terminals of two or more connection control switching elements to which the same connection control signal is applied among connection control switching elements in the plurality of demultiplexers.

(8) An active matrix substrate according to a certain embodiment of the present invention includes the configuration of (7) described above, and the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and the active matrix substrate further includes two or more signal lines for respectively transmitting the same control signal to the two or more boost circuit groups.

(9) An active matrix substrate according to a certain embodiment of the present invention includes the configuration of any one of (1) to (8) described above, and each of the plurality of boost circuits further includes a boost capacitor, a first input terminal connected to the internal node via the charging/discharging switching element, a second input terminal connected to a control terminal of the charging/discharging switching element, and a third input terminal connected to the internal node via the boost capacitor, and the second input terminal of each of the plurality of boost circuits is connected to an internal node of another boost circuit operated by a control signal different from a control signal for operating the boost circuit.

(10) An active matrix substrate according to a certain embodiment of the present invention includes the configuration of (9) described above, and each of the plurality of boost circuits further includes a transistor of a diode-connected form, and the internal node in each of the plurality of boost circuits is connected to the first input terminal via the transistor of the diode-connected form.

(11) An active matrix substrate according to a certain embodiment of the present invention includes the configuration of any one of (1) to (10) described above, and each switching element and transistor included in the demultiplexing circuit is a thin film transistor having a channel layer formed of an oxide semiconductor.

(12) A display device according to an embodiment of the present invention the active matrix substrate according to any one of (1) to (11) described above, a source drive circuit that drives the plurality of data signal lines via the demultiplexing circuit, a scan signal line drive circuit that drives the plurality of scan signal lines, and a display control circuit that controls the scan signal line drive circuit, the source drive circuit, and the demultiplexing circuit such that a plurality of data signals representing an image to be displayed are applied to the plurality of data signal lines in response to scan of the plurality of scan signal lines.

(13) The display device according to a certain embodiment of the present invention includes the configuration of (12) described above, and the display control circuit controls the demultiplexing circuit such that a voltage of the internal node is boosted by any of the plurality of boost circuits at least once before a drive of the plurality of scan signal lines starts from a state where a drive of the plurality of data signal lines and a drive of the plurality of scan signal lines stop.

(14) The display device according to a certain embodiment of the present invention includes the configuration of (12) or (13) described above, and the display control circuit controls the demultiplexing circuit such that a voltage of the internal node is boosted by any of the plurality of boost circuits at least once before a drive of the plurality of scan signal lines restarts from a state where a drive of the plurality of data signal lines and a drive of the plurality of scan signal lines are halted.

(15) A drive method according to a certain embodiment of the present invention is a drive method of a display device including an active matrix substrate including a plurality of data signal lines, a plurality of scan signal lines intersecting the plurality of data signal lines, a plurality of pixel formation portions arranged along the plurality of data signal lines and the plurality of scan signal lines, and a demultiplexing circuit that includes a plurality of demultiplexers respectively corresponding to a plurality of sets of data signal lines obtained by grouping the plurality of data signal lines, each set including two or more data signal lines, and includes a plurality of input terminals respectively corresponding to the plurality of demultiplexers, in which each of the plurality of demultiplexers includes two or more connection control switching elements respectively corresponding to the two or more data signal lines in a corresponding set, first conduction terminals of the two or more connection control switching elements are all connected to corresponding input terminals, and second conduction terminals of the two or more connection control switching elements are respectively connected to the two or more data signal lines of the corresponding set in each of the plurality of demultiplexers, the demultiplexing circuit includes a plurality of boost circuits that generate connection control signals to be applied to control terminals of the connection control switching elements included in the plurality of demultiplexers, and each of the plurality of boost circuits includes an internal node connected to a control terminal of a connection control switching element to which a connection control signal to be generated is applied and a charging/discharging switching element for charging and discharging the internal node, the drive method includes a demultiplexing step of demultiplexing multiplexed data signals applied to input terminals corresponding to each of the plurality of demultiplexers to generate two or more data signals to be respectively applied to the two or more data signal lines of the corresponding set, in which the demultiplexing step includes a charging step of precharging the internal node in each of the plurality of boost circuits via the charging/discharging switching element in response to a demultiplexing control signal applied to the demultiplexing circuit, and a boost step of boosting a voltage of the internal node in response to the demultiplexing control signal after precharging is performed by the charging step in each of the plurality of boost circuits, and a boosted voltage of an internal node in another boost circuit is applied to the control terminal of the charging/discharging switching element included in each of the plurality of boost circuits in the charging step.

These and other objects, characteristics, aspects, and effects of the present invention will become more apparent from the following detailed description of the present invention with reference to the accompanying drawings.

DESCRIPTION OF THE PREFERRED EMBODIMENTS

Hereinafter, embodiments are described with reference to the accompanying drawings. In each transistor described below, a gate terminal corresponds to a control terminal, one of a drain terminal and a source terminal corresponds to a first conduction terminal, and the other corresponds to a second conduction terminal. Further, all transistors according to the present embodiments are N-channel type thin film transistors (TFTs) but are not limited thereto. Further, a term "connection" in the present specification means "electrical connection" unless otherwise specified, and it is assumed that the connection includes not only a case of meaning direct connection but also a case of meaning indirect connection via other elements, within the scope not departing from the gist of the present invention.

1. First Embodiment

1.1 Overall Configuration and Operation Overview

Figure 1:
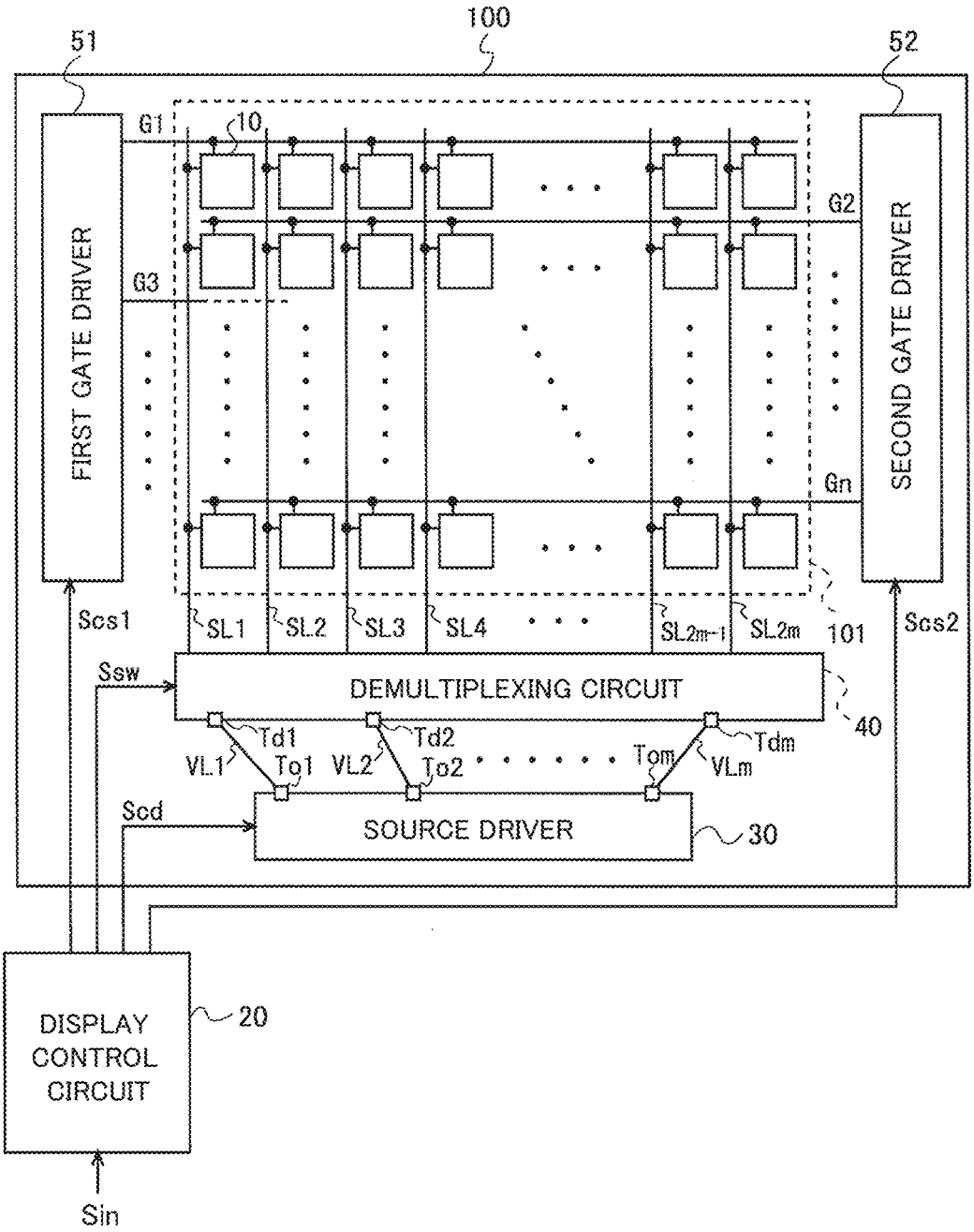
FIG. 1 is a block diagram illustrating an overall configuration of a display device including an active matrix substrate according to a first embodiment.

FIG. 1 is a block diagram illustrating an overall configuration of a liquid crystal display device of a monolithic DEMUX method (hereinafter, also referred to as a "display device of a first embodiment") including an active matrix substrate 100 according to the first embodiment. A display unit 101 is formed on the active matrix substrate 100, together with first and second gate drivers 51 and 52 as a scan signal line drive circuit, and a demultiplexing circuit 40, and furthermore, a source driver 30 as a source drive circuit is mounted (for example, COG mounting). The liquid crystal display device includes a display control circuit 20 in addition to the active matrix substrate 100 and the source driver 30 mounted thereon. An input signal Sin is applied to the display control circuit 20 from the outside, and the input signal Sin includes an image signal representing an image to be displayed and a timing control signal for displaying the image.

Figure 2:
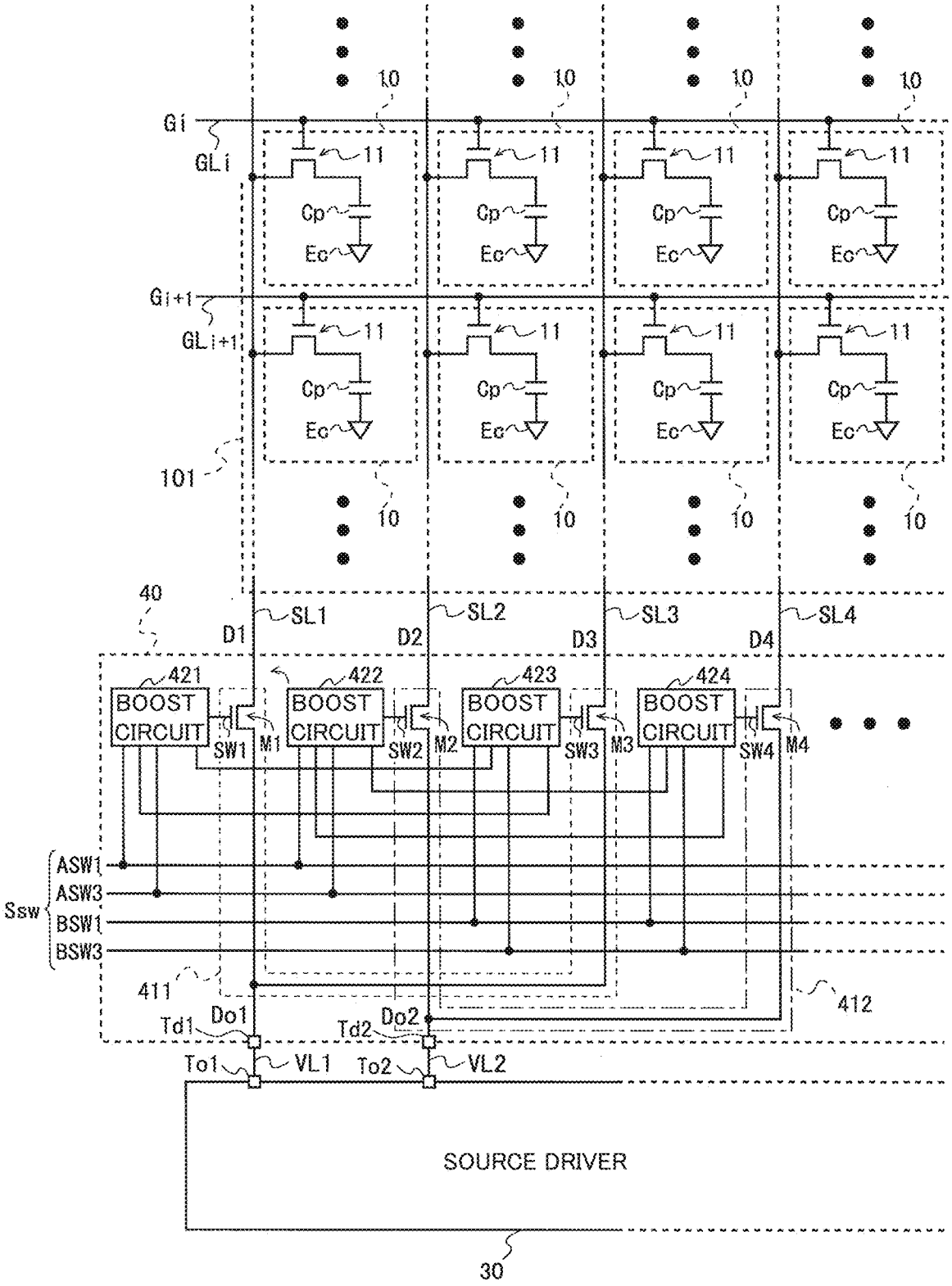
FIG. 2 is a circuit diagram illustrating a configuration of a demultiplexing circuit according to the first embodiment together with an electrical configuration of a display unit.

FIG. 2 is a circuit diagram illustrating a configuration of the demultiplexing circuit 40 in the active matrix substrate 100 according to the present embodiment together with an electrical configuration of the display unit 101. As illustrated in FIGS. 1 and 2, a plurality (2m) of source bus lines SL1 to SL2*m* as data signal lines, a plurality (n) of gate bus lines GL1 to GLn as scan signal lines, and a plurality (n×2m) of pixel formation portions 10 arranged in a matrix type along the source bus lines SL1 to SL2*m* and the gate bus lines GL1 to GLn are provided in the display unit 101 of the active matrix substrate 100.

Each pixel formation portion 10 corresponds to any one of the source bus lines SL1 to SL2*m*, corresponds to any one of the gate bus lines GL1 to GLn, and is coupled to corresponding gate bus line GLi and source bus line SLj ($1 \le i \le n$ and $1 \le j \le 2m$).

As illustrated in FIG. 2, each pixel formation portion 10 is configured with a thin film transistor (hereinafter, abbreviated as "TFT") 11 as a switching element, having a gate terminal as a control terminal connected to a corresponding gate bus line GLi and a source terminal connected to a corresponding source bus line SLj, a pixel electrode Ep connected to a drain terminal of the TFT 11, a common electrode Ec commonly provided in the n×2m pixel formation portions 10, and a liquid crystal layer that is interposed between the pixel electrode Ep and the common electrode Ec and is commonly provided in the n×2m pixel formation portions 10. A pixel capacitance Cp is configured by a liquid crystal capacitor formed by the pixel electrode Ep and the common electrode Ec. Typically, an auxiliary capacitor is provided in parallel with the liquid crystal capacitor to firmly hold a voltage in the pixel capacitor Cp, but the auxiliary capacitor is not directly related to the present invention, and thus, description and illustration thereof are omitted.

A thin film transistor using amorphous silicon for a channel layer, a thin film transistor (LTPS-TFT) using low temperature polysilicon for a channel layer, or a thin film transistor (oxide TFT) using an oxide semiconductor for a channel layer can be adopted as the TFT 11 in the pixel formation portion 10. For example, a thin film transistor having an oxide semiconductor layer containing an In—Ga—Zn—O-based semiconductor (for example, an indium gallium zinc oxide) can be used as the oxide TFT. In the present embodiment, it is assumed that an oxide TFT is used as the TFT 11 in the pixel formation portion 10. It is assumed that the first and second gate drivers 51 and 52 and the demultiplexing circuit 40 are integrally formed with the pixel formation portion 10 on the active matrix substrate 100, and an oxide TFT is also used for the TFT in the demultiplexing circuit 40.

A display control circuit 20 receives an input signal Sin from the outside, and generates and outputs a data side control signal Scd, a first scan side control signal Scs1, a second scan side control signal Scs2, a demultiplexing control signal Ssw, and a common voltage Vcom (not illustrated), based on the input signal Sin. The data side control signal Scd is applied to the source driver 30 as a source drive circuit, the first scan side control signal Scs1 is applied to the first gate driver 51, the second scan side control signal Scs2 is applied to the second gate driver 52, and the demultiplexing control signal Ssw is applied to the demultiplexing circuit 40.

The first gate driver 51 generates scan signals G1, G3, . . . for sequentially selecting odd-numbered gate bus lines GL1, GL3, . . . , respectively, based on the first scan side control signal Scs1 to apply to the gate bus lines GL1, GL3, . . . , respectively. The second gate driver 52 generates scan signals G2, G4, . . . for sequentially selecting the even-numbered gate bus lines GL2, GL4, . . . , respectively, based on the second scan side control signal Scs2 to apply to the gate bus lines GL2, GL4, . . . , respectively. By driving the gate bus lines GL1 to GLn by using the first and second gate drivers 51 and 52, the n gate bus lines GL1 to GLn are sequentially selected for each horizontal period, and sequential selection of the gate bus lines GL1 to GLn is repeated with one frame period as a cycle. Here, the "horizontal period" refers to a period of a portion corresponding to one line of a display image in a video signal based on a horizontal scan and a vertical scan. A selection period of the gate bus lines GL1 to GLn may be configured to be sequentially selected by a plurality of horizontal periods (for example, two horizontal periods). Further, in the example illustrated in FIG. 1, the odd-numbered gate bus lines GL1, GL3, . . . are configured to be driven by the first gate driver 51, and the even-numbered gate bus lines GL2, GL4, . . . are configured to be driven by the second gate driver 52, but instead of this, one end side of the n gate bus lines GL1 to GLn may be configured to be driven by the first gate driver 51 and the other end side of the n gate bus lines GL1 to GLn may be configured to be driven by the second gate driver 52. Further, instead of this, only one gate driver is disposed on one end side or the other end side of the n gate bus lines GL1 to GLn, and the n gate bus lines GL1 to GLn may be configured to be driven by the one gate driver. Hereinafter, in a configuration in which the gate bus lines GL1 to GLn are driven by the first and second gate drivers 51 and 52, the circuit configured by the first and second gate drivers 51 and 52 may be referred to as a "gate driver".

The data side control signal Scd applied to the source driver 30 includes an image signal Sv representing an image to be displayed and a data side timing control signal Sct (for example, a start pulse signal, a clock signal, or the like). The source driver 30 generates and outputs data side output signals Do1 to Dom at a timing corresponding to the drive of the gate bus lines GL1 to GLn made by the scan signals G1 to Gn, based on the data side control signal Scd, thereby, driving the source bus lines SL1 to SL2*m* via the demultiplexing circuit 40 (details are described below). Generally, in a display device of a DEMUX method, the source bus lines in the active matrix substrate are grouped into a plurality of sets, each set including two or more source bus lines, and the source driver includes a plurality of output terminals corresponding to the plurality of sets as output terminals for driving the source bus lines. As illustrated in FIG. 2, in the present embodiment, two source bus lines SLj and SLj+2 are grouped as one set, and thus, 2m source bus lines SL1 to SL2*m* in the active matrix substrate 100 are grouped into m sets of source bus lines (SL1 and SL3), (SL2 and SL4), (SL5 and SL7), (SL6 and SL8), . . . , (SL2*m*−2 and SL2*m*), and the source driver 30 includes m output terminals To1 to Tom respectively corresponding to the m sets as output terminals for driving the source bus lines. The data side output signal Dok output from each output terminal Tok (k=1 to m) is a data signal (hereinafter, referred to as "multiplexed data signal") obtained by time-divisionally multiplexing the data signals Dj and DJ+2 to be respectively applied to the two source bus lines SLj and SLJ+2 of the corresponding set.

The demultiplexing circuit 40 is integrally formed with the display unit 101 on the active matrix substrate 100, receives the multiplexed data signals Do1 to Dom from the source driver 30, and demultiplexes the multiplexed data signals Do1 to Dom to apply respectively to the source bus lines SL1 to SL2*m* as 2*m* data signals D1 to D2*m*. That is, the demultiplexing circuit 40 according to the present embodiment includes m demultiplexers 411 to 41*m* respectively corresponding to the m source bus line groups SLj and SLJ+2, and has m input terminals Td1 to Tdm respectively corresponding to the m demultiplexers 411 to 41*m*. The m input terminals Td1 to Tdm are respectively coupled to the m output terminals To1 to Tom of the source driver 30 via the data output lines VL1 to VLm, and the multiplexed data signals Do1 to Dom output from the source driver 30 are respectively applied to the input terminals Td1 to Tdm of the demultiplexing circuit 40. Each demultiplexer 41*k* couples data output line VLk coupled to the corresponding input terminal Tdk to either one of the two source bus lines SLj and SLJ+2 of the corresponding set, based on the demultiplexing control signal Ssw, and switches the source bus line coupled to the data output line VLkb between the two source bus lines SLj and SLJ+2 in each horizontal period. Thereby, the multiplexed data signal Dok applied to each input terminal Tdk of the demultiplexing circuit 40 is demultiplexed to be applied to the two source bus lines SLj and SLJ+2 in the corresponding set as the data signals Dj and DJ+2.

A liquid crystal display device including the active matrix substrate 100 according to the present embodiment adopts a method of driving the source bus lines SL1 to SLm such that polarities of the data signals Dj and Dj+1 applied to the adjacent source bus lines SLj and SLj+1 are different from each other. Here, a so-called column inversion drive method is adopted, but a drive method of the liquid crystal display device is not limited thereto. As illustrated in FIG. 2, in the present embodiment, the source bus lines of each set are configured by two source bus lines SLj and SLJ+2 selected for each set in accordance with the adopted inversion drive method. Thereby, a polarity of the multiplexed data signal Dok output from each output terminal Tok of the source driver 30 is maintained constant during one frame period.

As illustrated in FIG. 2, each of the demultiplexers 411 to 41*m* in the demultiplexing circuit 40 includes two TFTs (hereinafter, referred to as "coupling control transistors") Mj and MJ+2 as two coupling control switching elements respectively coupled to the two source bus lines SLj and SLJ+2 of a corresponding set, and an input terminal (a terminal to which the data output line VLk is coupled) of the demultiplexer 41*k* is connected to one source bus line SLj of the two source bus lines via one coupling control transistor Mj of the two connection control transistor, and is also connected to the other source bus line SLJ+2 via the other connection control transistor MJ+2. Further, the demultiplexing circuit 40 includes a boost circuit 42*j* generating a control signal (hereinafter, referred to as a "connection control signal") SWj to be applied to a gate terminal of each connection control transistor Mj (j=1 to 2m).

The demultiplexing circuit 40 demultiplexes the m multiplexed data signals Do1 to Dom output from the source driver 30, based on the demultiplexing control signal Ssw to respectively apply to the source bus lines SL1 to SL2*m* as the data signals D1 to D2*m*.

As described above, the data signals D1 to D2*m* are applied to the source bus lines SL1 to SL2*m*, and the scan signals G1 to Gn are applied to the gate bus lines GL1 to GLn. Further, a predetermined common voltage Vcom is supplied from the display control circuit 20 to the common electrode Ec. By driving the source bus lines SL1 to SL2*m* and the gate bus lines GL1 to GLn in the display unit 101 as described above, pixel data based on the image signal Sv is written in each pixel formation portion 10 and not illustrated on the back surface of the display unit 101. By irradiating light from the backlight, the image represented by the image signal Sv included in the input signal Sin from the outside is displayed on the display unit 101.

1.2 Details of Configuration and Operation of Demultiplexing Circuit

In the demultiplexing circuit 40 according to the present embodiment, the connection control signals SW1 to SW2*m* generated by the boost circuits 421 to 42(2m) based on the demultiplexing control signal Ssw control on/off of the connection control transistors M1 to M2*m*. Thereby, among the two connection control transistors Mj and Mj+2 in each demultiplexer 41*k* (k=1 to m), the connection control transistor (referred to as "A connection control transistor") Mj denoted by a smaller number is turned on when the data signal Dj is applied to the source bus line SLj connected thereto in each horizontal period, and the connection control transistor (referred to as "B connection control transistor") Mj+2 denoted by a larger number is turned on when the data signal Dj+2 is applied to the source bus line SLj+2 connected thereto in each horizontal period. Hereinafter, details of a configuration and an operation of the demultiplexing circuit 40 are described with reference to FIGS. 3 to 5.

Figure 3A:
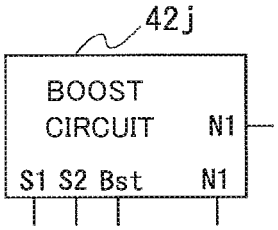
FIGS. 3A and 3B are diagrams illustrating a configuration of a boost circuit included in the demultiplexing circuit illustrated in FIG. 2.
Figure 3B:
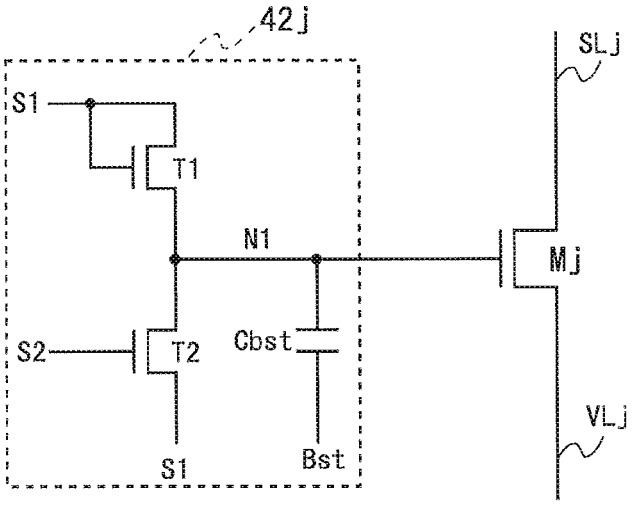
Figure 4A:
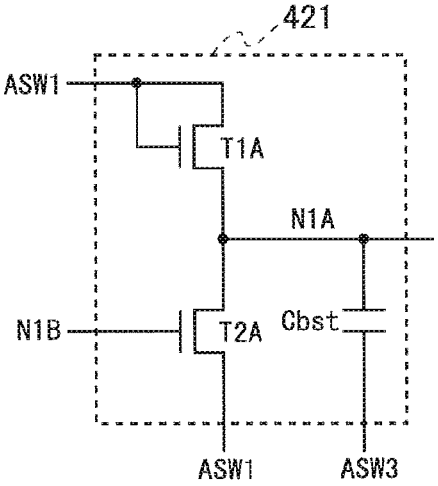
FIGS. 4A and 4B are diagrams illustrating a connection between boost circuits included in the demultiplexing circuit illustrated in FIG. 2.
Figure 4B:
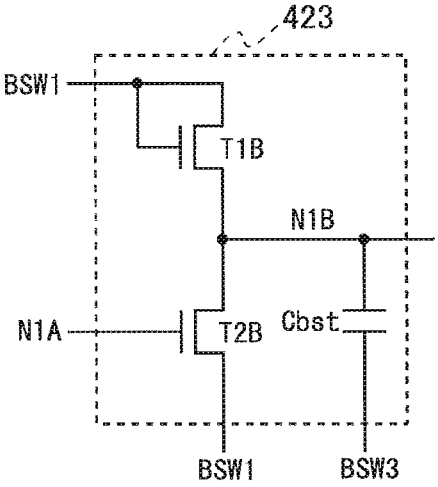
Figure 5:
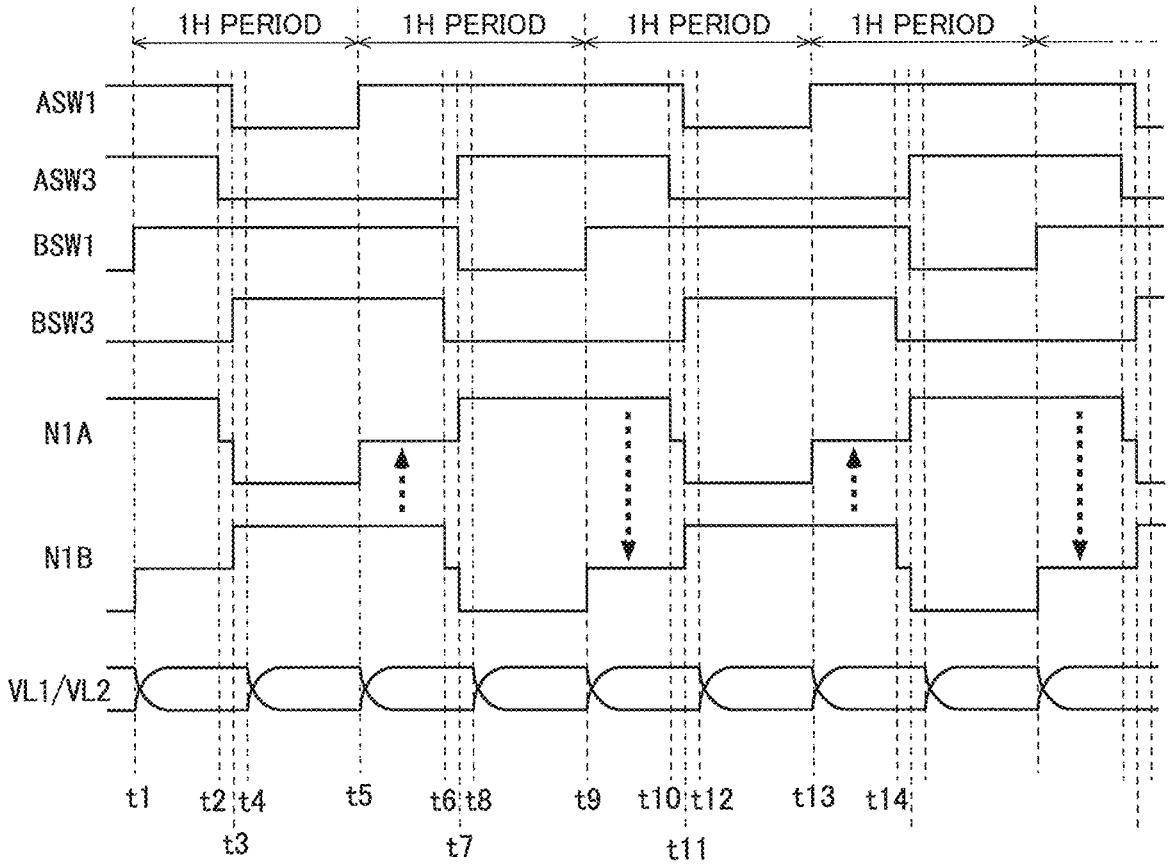
FIG. 5 is a signal waveform diagram illustrating an operation of the demultiplexing circuit according to the first embodiment.

FIG. 3A is a diagram illustrating terminals of the boost circuit 42*j*, and FIG. 3B is a circuit diagram illustrating a configuration of the boost circuit 42*j* (j=1 to 2m). FIGS. 4A and 4B are circuit diagrams illustrating coupling between the boost circuits included in the demultiplexing circuit 40. FIG. 5 is a signal waveform diagram illustrating an operation of the demultiplexing circuit 40.

The demultiplexing control signal Ssw applied to the demultiplexing circuit 40 is configured with two A control signals ASW1 and ASW3 and two B control signals BSW1 and BSW3 illustrated in FIG. 5. The A control signals ASW1 and ASW3 are input to the boost circuit 42*j* generating the connection control signal (hereinafter, referred to as an "A connection control signal") SWj to be applied to a gate terminal of the A connection control transistor Mj of the two connection control transistors Mj and Mj+2 included in each demultiplexer 41*k*, and the B control signals BSW1 and BSW3 are input to the boost circuit 42(*j*+2) generating the connection control signal SWj+2 (hereinafter, referred to as a "B connection control signal") to be applied to a gate terminal of the B connection control transistor Mj+2 of the two connection control transistors Mj and Mj+2.

As illustrated in FIG. 3A, the boost circuit 42*j* has first to third input terminals S1, S2, and Bst as input terminals and first and second output terminals N1 and N1 as output terminals and is configured as illustrated in FIG. 3B. That is, the boost circuit 42*j* includes two N-channel type TFTs (hereinafter, simply referred to as "transistors") T1 and T2 and a boost capacitor Cbst. The transistor T1 has a form in which a gate terminal thereof is connected to a drain terminal, that is, a diode-connected form, the drain terminal and the gate terminal are connected to the input terminal S1, and the source terminal is connected to a drain terminal of the transistor T2. The transistor T2 functions as a charging/discharging switching element, a gate terminal thereof is connected to the second input terminal S2, and a source terminal thereof is connected to the first input terminal S1. An internal node N1 including a connection point between the transistor T1 and the transistor T2 is connected to the third input terminal Bst via the boost capacitor Cbst. Further, the internal node N1 is connected to the first and second output terminals N1 and N1, and a voltage of the internal node N1 is applied to a connection control transistor Mj (j=1 to 2 m) as the connection control signal (the A connection control signal or the B connection control signal) SWj.

As can be seen from FIGS. 2, 3, and 4, in the boost circuit (hereinafter, referred to as an "A boost circuit") 42*j* (j=1, 2, 5, 6, 9, 10, . . . , 2m−2) that generates the A connection control signal SWj, the A control signals ASW1 and ASW3 are applied to the first and third input terminals S1 and Bst, respectively, and a voltage of an internal node N1 (an internal node N1B illustrated in FIG. 4B) in the boost circuit (hereinafter, referred to as a "B boost circuit") 42(*j*+2) generating the B connection control signal SWj+2 is applied to the second input terminal S2. Further, a voltage of the internal node N1 (an internal node N1A illustrated in FIG. 4A) in the A boost circuit 42*j* passes via the first output terminal N1 to be applied to the second input terminal S2 in the B boost circuit 42(*j*+2) (see FIG. 2 and FIG. 4). Further, the voltage of the internal node N1 (internal node N1A) in the A boost circuit 42*j* is applied to the gate terminal of the A connection control transistor Mj via the second output terminal N1 as the A connection control signal SWj, and the voltage of the internal node N1 (internal node N1B) in the B boost circuit 42(*j*+2) is applied to the gate terminal of the B connection control transistor Mj+2 via the second output terminal N1 as the B connection control signal SWj+2.

The demultiplexing circuit 40 including the boost circuits 421 to 42(2m) configured as described above operates as follows based on the demultiplexing control signal Ssw from the display control circuit 20, that is, the A control signals ASW1 and ASW3 and the B control signals BSW1 and BSW3 illustrated in FIG. 5. Hereinafter, the operation of the demultiplexing circuit 40 is described by focusing on the A boost circuit 421 and the B boost circuit 423 illustrated in FIG. 4.

The A connection control transistor M1 to which the A connection control signal SW1 generated by the A boost circuit 421 is applied and the B connection control transistor M3 to which the B connection control signal SW3 generated by the B boost circuit 423 is applied configure the first demultiplexer 411, and signals obtained by time-divisionally multiplexing the data signals D1 and D3 to be applied to the two source bus lines SL1 and SL3, respectively, are applied to the input terminal of the demultiplexer 411 via the data output line VL1 as a multiplexed data signal Do1. Signals obtained by time-divisionally multiplexing the data signals D2 and D4 to be applied to the two source bus lines SL2 and SL4 are input to the input terminals of the second demultiplexer 412 via the data output line VL2 as the multiplexed data signal Dot. More specifically, a voltage of the data signal D1 is applied to the first demultiplexer 411 via the data output line VL1 in one of the first half and the second half of each horizontal period (also referred to as "1H period"), and a voltage of the data signal D3 is applied to the first multiplexer 411 via the data output line VL1 in the other period. Further, a voltage of the data signal D2 is applied to the second demultiplexer 412 via the data output line VL2 in one of the first half and the second half of each 1H period, and a voltage of the data signal D4 is applied to the second demultiplexer 412 via the data output line VL2 in the other period. The same applies to the other demultiplexers 413 to 41*m*.

As illustrated in FIG. 5, one B control signal BSW1 of the demultiplexing control signal Ssw changes from a low level (L level) to a high level (H level) at a start point in time t1 (time t1) in a certain 1H period. Thereby, the internal node N1B of the B boost circuit 423 illustrated in FIG. 4B is precharged via the transistor T1B of a diode-connected form. During a normal operation (not a start time of drive of the display unit 101, a restart time of from a pause period, and so on), and at this time, the internal node N1A of the A boost circuit 421 illustrated in FIG. 4A is at an H level, and the internal node N1B of the B boost circuit 423 is also precharged via the transistor T2B. Thereafter, at a time t3, the other B control signal BSW3 of the demultiplexing control signal Ssw changes from an L level to an H level, and thereby, the voltage of the internal node N1B of the B boost circuit 423 is boosted via the boost capacitor Cbst to become a voltage (an H level of this voltage is referred to as a "boost H level") higher than a voltage of an H level.

Thereafter, at a time t4, a voltage applied from the source driver 30 to the data output line VL1 changes from the voltage of the data signal D1 to be applied to the source bus line SL1 to the voltage of the data signal D3 to be applied to the source bus line SL3, and the voltage of the data signal D3 is applied to the source bus line SL3 via the connection control transistor M3 to which a voltage of the boost H level of the internal node N1B is applied.

At a time t5 when the 1H period ends and the next 1H period (hereinafter, referred to as a "second 1H period") starts, a voltage applied from the source driver 30 to the data output line VL1 changes to the voltage of the data signal D3 of the next display line to be applied to the source bus line SL3. Further, at the time t5, one A control signal ASW1 of the demultiplexing control signal Ssw changes from an L level to an H level. Thereby, the internal node N1A of the A boost circuit 421 illustrated in FIG. 4A is precharged via the transistor T1A of a diode-connected form. At this time, the voltage of the internal node N1B of the B boost circuit 423 illustrated in FIG. 4B is at the boost H level, and the internal node N1A of the A boost circuit 421 is also precharged via the transistor T2A that is turned on by a voltage of this boost H level. In FIG. 5, a bold dotted arrow denoted between the time t5 and a time t6 indicates that the internal node N1A of the A boost circuit 421 is precharged based on the voltage of the boost H level of the internal node N1B of the B boost circuit 423 in this way.

Thereafter, at the time t6, the other B control signal BSW3 of the demultiplexing control signal Ssw changes from an H level to an L level, and at a time t7, the one B control signal BSW1 also changes from an H level to an L level. According to this, the voltage of the internal node N1B of B boost circuit 423 is decreased to reach an L level at the time t7. Further, at the time t7, the other A control signal ASW3 of the demultiplexing control signal Ssw changes from an L level to an H level, the voltage of the internal node N1A of the A boost circuit 421 is boosted via the boost capacitor Cbst to become a voltage higher than a voltage of an H level, that is, a voltage of the boost H level. Due to this voltage, the transistor T2B of the B boost circuit 423 illustrated in FIG. 4B is turned on by the voltage of the boost H level, and the internal node N1B of the B boost circuit 423 is reset to the above-described one B control signal BSW1 (changes to an L level) via the transistor T2B, which contributes to a rapid decrease in the voltage of the internal node N1B of the B boost circuit 423.

From the above description, in the period t5 to t6, the voltage of the data signal D3 of the next display line to be applied to the source bus line SL3 is applied to the source bus line SL3 via the connection control transistor M3 that is turned on by the boosted voltage of the internal node N1B (the voltage of the boost H level).

Thereafter, at a time t8, a voltage applied from the source driver 30 to the data output line VL1 changes from the voltage of the data signal D3 to be applied to the source bus line SL3 to the voltage of the data signal D1 to be applied to the source bus line SL1, and the voltage of the data signal D1 is applied to the source bus line SL1 via the connection control transistor M1 which is turned on by the boosted voltage of the internal node N1A (the voltage of the boost H level).

At a time t9 when the second 1H period ends and the next 1H period (hereinafter, also referred to as a "third 1H period") starts, a voltage applied from the source driver 30 to the data output line VL1 changes to the voltage of the data signal D1 of the next display line to be applied to the source bus line SL1. Further, at the time t9, the above-described one B control signal BSW1 of the demultiplexing control signal Ssw changes from an L level to an H level. Thereby, the internal node N1B of the B boost circuit 423 illustrated in FIG. 4B is precharged via the transistor T1B of a diode-connected form. At this time, the voltage of the internal node N1A of the A boost circuit 421 illustrated in FIG. 4A is at the boost H level, and the internal node N1B of the B boost circuit 423 is also precharged via the transistor T2B that is turned on by the voltage of the boost H level. In FIG. 5, a bold dotted arrow denoted between the time t9 and a time t10 indicates that the internal node N1B of the B boost circuit 423 is precharged based on the voltage of the boost H level of the internal node N1A of the A boost circuit 421 in this way.

Thereafter, at the time t10, the other A control signal ASW3 of the demultiplexing control signal Ssw changes from an H level to an L level, and at a time t11, the one A control signal ASW1 also changes from an H level to an L level. According to this, the voltage of the internal node N1A of the A boost circuit 421 decreases to reach an L level at the time t11. Further, at the time t11, the other B control signal BSW3 of the demultiplexing control signal Ssw changes from an L level to an H level, and thereby, the voltage of the internal node N1B of the B boost circuit 423 is boosted via the boost capacitor Cbst to become a voltage higher than a voltage of an H level, that is, the voltage of the boost H level. Due to this voltage, the transistor T2A of the A boost circuit 421 illustrated in FIG. 4A is turned on by the voltage of the boost H level, and the internal node N1A of the A boost circuit 421 is reset to the above-described one A control signal ASW1 (changes to an L level) via the transistor T2A, which contributes to a rapid decrease in the voltage of the internal node N1A of the A boost circuit 421.

From the above description, in the period t9 to t10, the voltage of the data signal D1 of the next display line to be applied to the source bus line SL1 is applied to the source bus line SL1 via the connection control transistor M1 which is turned on by the boosted voltage of the internal node N1A.

Thereafter, at a time t12, a voltage applied from the source driver 30 to the data output line VL1 changes from the voltage of the data signal D1 to be applied to the source bus line SL1 to the voltage of the data signal D3 to be applied to the source bus line SL3, and the voltage of the data signal D3 is applied to the source bus line SL3 via the connection control transistor M3 which is turned on by the boosted voltage of the internal node N1B.

Hereinafter, in the same manner, the internal node N1A of the A boost circuit such as the boost circuit 421 illustrated in FIG. 4A is precharged via the transistor T2A that is turned on by the voltage of the boost H level of the internal node N1B of the B boost circuit such as the boost circuit 423 illustrated in FIG. 4B, and thereafter, the voltage of the internal node N1A is boosted via the boost capacitor Cbst to reach the boost H level. Meanwhile, the internal node N1B of the B boost circuit such as the boost circuit 423 illustrated in FIG. 4B is precharged via the transistor T2B that is turned on by the voltage of the boost H level of the internal node N1A of the A boost circuit such as the boost circuit 421 illustrated in FIG. 4A, and thereafter, the voltage of the internal node N1B is boosted via the boost capacitor Cbst to reach the boost H level. Among the two connection control transistors Mj and Mj+2 configuring each demultiplexer 41*k* (k=1 to m), when the A connection control transistor Mj is turned on, the voltage of the boost H level is applied to a gate terminal thereof from the internal node N1A of the A boost circuit, and when the B connection control transistor Mj+2 is turned on, the voltage of the boost H level is applied to a gate terminal thereof from the internal node N1B of the B boost circuit.

By controlling the connection control transistors Mj and Mj+2 in each demultiplexer 41*k* (k=1 to m) as described above, m multiplexed data signals Do1 to Dom output from the source driver 30 are demultiplexed to be applied to the source bus lines SL1 to SL2*m* as the data signals D1 to D2*m*, respectively.

As will be understood from the above description, a precharge voltage of the internal node N1 in the boost circuit 42*j* is consequently determined by a voltage of the control signal ASW1 or BSW1 applied through the transistor T2 as a charging/discharging switching element, and thus, the transistor T1 of a diode-connected form is not always necessary. However, the transistor T1 of a diode-connected form is preferably provided to properly charge the internal node N1 at the restart time of driving the source bus line SLi after a pause period to be described below or at the start time of the source bus line SLj after power is supplied.

1.3 Comparative Example of Boost Circuit Used for Demultiplexing Circuit

Next, a boost circuit used for a demultiplexing circuit in an active matrix substrate of a DEMUX method of the related art is described as a comparative example of the boost circuit 42*j* used for the demultiplexing circuit 40 according to the present embodiment. Here, a boost circuit used for a DEMUX circuit included in an active matrix substrate according to a twelfth embodiment described in International Publication No. 2018/190245 is used as a comparative example (see paragraphs [0145] to [0150] of the document, FIG. 18 and FIG. 19).

Figure 6:
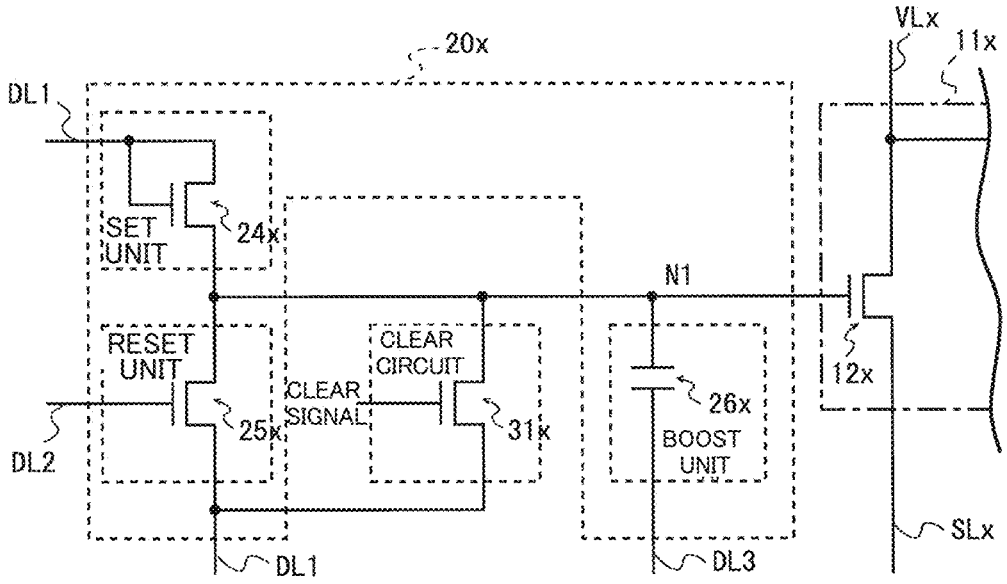
FIG. 6 is a circuit diagram illustrating a configuration of a boost circuit included in a demultiplexing circuit in an active matrix substrate of the related art as a comparative example.
Figure 7:
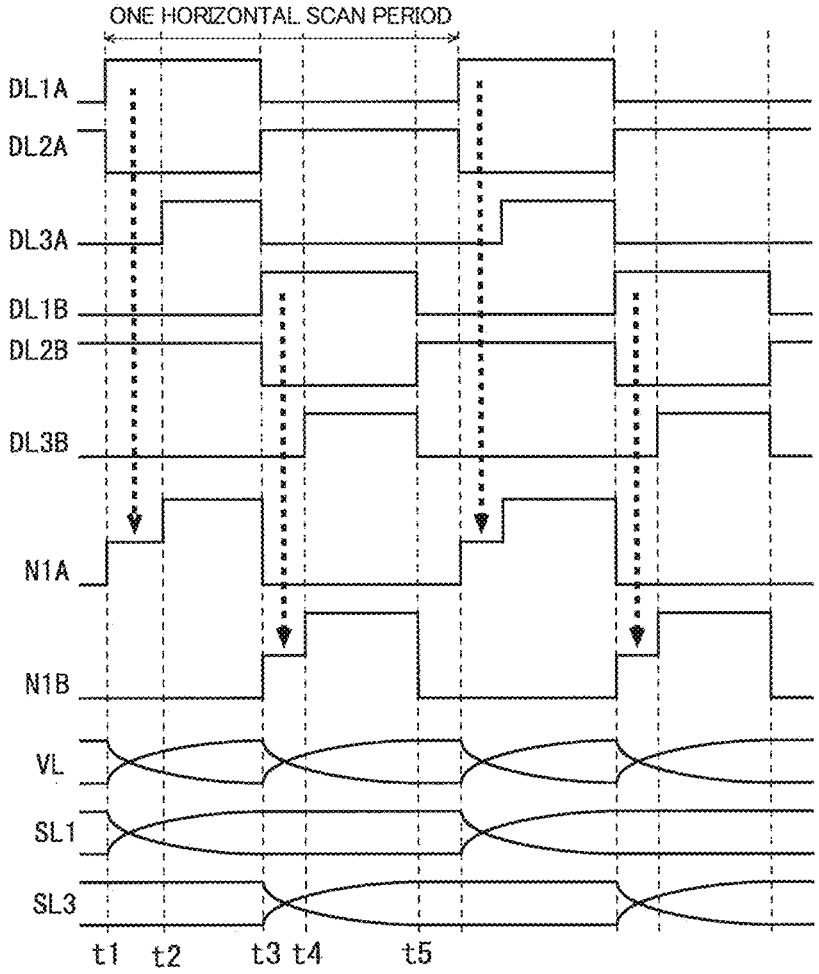
FIG. 7 is a signal waveform diagram illustrating an operation of the demultiplexing circuit of the related art including the boost circuit as the comparative example.

FIG. 6 is a circuit diagram illustrating a configuration of a boost circuit 20*x* as a comparative example. The boost circuit 20*x* illustrated in FIG. 6 corresponds to the boost circuit 42*j* according to the present embodiment, and a switching TFT 12*x* corresponds to the connection control transistor Mj included in the demultiplexing circuit 40 according to the present embodiment (j=1 to 2 m). A setting TFT 24*x* and a boost capacitance element 26*x* included in the boost circuit 20*x* as a comparative example respectively correspond to the transistor T1 and the boost capacitor Cbst included in the boost circuit 42*j* according to the present embodiment (see FIG. 3B). FIG. 7 is a signal waveform diagram illustrating an operation of a demultiplexing circuit of the related art including the boost circuit 20*x* as the comparative example. Signals of the drive signal lines DL1A, DL2A, and DL3A illustrated in FIG. 7 are respectively applied to drive signal lines DL1, DL2, and DL3 illustrated in FIG. 6, or signals of drive signal lines DL1B, DL2B, and DL3B illustrated in FIG. 7 are respectively applied thereto. Here, it is assumed that the signals of the drive signal lines DL1A, DL2A, DL3A illustrated in FIG. 7 are respectively applied to the drive signal lines DL1, DL2, and DL3 illustrated in FIG. 6, and in this case, voltage waveforms of the internal node N1 of the boost circuit 20*x* are illustrated as voltage waveforms of the internal node N1A in FIG. 7.

As illustrated in FIG. 7, at the start point in time (time t1) of one horizontal scan period corresponding to the 1H period (one horizontal period) in the present embodiment, a voltage of the drive signal line DL1 (DL1A) changes from an L level to an H level, and the internal node N1 is precharged by the voltage of the drive signal line DL1 of an H level. However, in the precharge, the voltage of the drive signal line DL1 of an H level is applied to the internal node N1 via the setting TFT 24*x* of a diode-connected form, and thus, the voltage of the internal node N1 (N1A) increases only to a voltage Vh-Vth obtained by subtracting a threshold voltage Vth (>0) of the setting TFT 24*x* from a voltage Vh of an H level of the drive signal line DL1. In FIG. 7, a bold dotted arrow denoted between a time t1 and a time t2 indicates that the internal node N1 (N1A) of the boost circuit 20*x* is precharged based on the voltage Vh of the drive signal line DL1 (DL1A) of an H level in this way (this arrow corresponds to the bold dotted arrow denoted between the time t5 and the time t6 in FIG. 5).

Thereafter, at time t2, a voltage of the drive signal line DL3 (DL3A) changes from an L level to an H level, and thereby, the voltage of the internal node N1 of the boost circuit 20*x* is boosted via a boost capacitance element 26*x* to become a voltage higher than a voltage of an H level, that is, the voltage of the boost H level. However, as described above, the voltage (hereinafter, referred to as a "precharge voltage") of the internal node N1 (N1A) obtained by the previous precharge operation (operation in the period t1 to t2) is not higher than the voltage Vh-Vth obtained by subtracting the threshold voltage Vth (>0) of the setting TFT 24*x* from the voltage Vh of an H level of the drive signal line DL1, and thus, accordingly, the voltage of the boost H level is also lower than a voltage of an H level of the internal node N1 of the boost circuit 42*j* according to the present embodiment.

In the above description, the signals of the drive signal lines DL1A, DL2A, and DL3A illustrated in FIG. 7 are applied respectively to the drive signal lines DL1, DL2, and DL3 illustrated in FIG. 6, but even when the signals of the drive signal lines DL1B, DL2B, and DL3B illustrated in FIG. 7 are applied respectively to the drive signal lines DL1, DL2, and DL3 illustrated in FIG. 6, the same precharge operation and boost operation are performed for the internal node N1 (N1B) of the boost circuit 20*x*. For example, in FIG. 7, a bold dotted arrow denoted between a time t3 and a time t4 indicates that the internal node N1 (N1B) of the boost circuit 20*x* is precharged based on the voltage Vh of the drive signal line DL1 (DL1B) of an H level, and even in this case, the voltage of the internal node N1 (N1B) does not increase to the voltage Vh-Vth obtained by subtracting the threshold voltage Vth (>0) of the setting TFT 24*x* from the voltage Vh of an H level of the drive signal line DLL As described above, a voltage of a boost H level obtained at the internal node N1 is applied to the switching TFT 12*x* (corresponding to the connection control transistor Mj according to the present embodiment) in the demultiplexing circuit, and also in the demultiplexing circuit using the boost circuit 20*x* of the comparative example, the data signals D1 to D2*m* to be applied respectively to the source bus lines SL1 to SL2*m* are generated from the time divisionally multiplexed data signals (signals of the output signal lines VL1 to VL2*m*) output from the source driver by the demultiplexing operation which is functionally equivalent to the demultiplexing operation of the present embodiment.

1.4 Effects

As described above, in the present embodiment, a voltage of the internal node N1 of the boost circuit 42*j* is applied, as the connection control signal SWj, to a gate terminal of each connection control transistor Mj (j=1 to 2m) as a switching element in the demultiplexing circuit 40 as illustrated in FIG. 3B. As illustrated in FIG. 2, the demultiplexing circuit 40 according to the present embodiment includes the boost circuit (the A boost circuit) 42*j* generating the connection control signal SWj to be applied to the gate terminal of the A connection control transistor Mj of the two connection control transistors Mj and Mj+2 in the demultiplexer 41*k*, and the boost circuit (the B boost circuit) 42(*j*+2) generating the connection control signal SWj+2 to be applied to the gate terminal of the B connection control transistor Mj+2 thereof, for each demultiplexer 41*k*.

As can be seen from FIG. 4A, the internal node N1A of the A boost circuit 42*j* is precharged not only via the transistor T1A of a diode-connected form but also precharged via the transistor T2A having a gate terminal to which a voltage of the internal node N1B of the B boost circuit 42(*j*+2) is applied. As illustrated in FIG. 5, during the period (periods t5 to t6 and t13 to t14) in which the internal node N1A of the A boost circuit 42*j* is precharged, a voltage of the internal node N1B of the B boost circuit 42(*j*+2) is previously boosted, and thus, a voltage of a boost H level is applied to the gate terminal of the transistor T2A of the A boost circuit 42*j*. That is, a voltage sufficiently higher than a voltage of the A control signal ASW1 for precharging the internal node N1A is applied to the gate terminal of the transistor T2A. Therefore, the precharge voltage of the internal node N1A can be increased more than the precharge voltage of the internal node N1 (N1A or N1B) in the comparative example. That is, in the comparative example described above, the precharge voltage of the internal node N1 (N1A or N1B) increases only to the voltage Vh-Vth obtained by subtracting the threshold voltage Vth (>0) of the setting TFT 24*x* from the voltage Vh of an H level of the drive signal line DL1, but, in the present embodiment, the voltage of the internal node N1A can be increased to the voltage of an H level of the A control signal ASW1.

Further, also in the B boost circuit 42(*j*+2) according to the present embodiment, the internal node N1B is precharged not only via the transistor T1B of a diode-connected form but also precharged via the transistor T2B having a gate terminal to which the voltage of the node N1A of the A boost circuit 42*j* is applied (see FIG. 4B). Therefore, the precharge voltage of the internal node N1B of the B boost circuit 42(*j*+2) can also be increased to a voltage of an H level of the B control signal BSW1 and can be higher than the precharge voltage of the internal node N1 (N1A or N1B) in the comparative example described above.

As described above, in the present embodiment, the precharge voltage of the internal node N1 (N1A or N1B) of the boost circuit 42*j* (j=1 to 2m) can be higher than the precharge voltage of the internal node N1 (N1A or N1B) in the comparative example, and thus, even if a voltage boosted via the boost capacitance element 26*x* or the boost capacitor Cbst (the amount of increase by a boost operation) is the same, the boosted voltage (voltage of a boost H level) of the internal node N1 of the boost circuit 42*j* (j=1 to 2m) can be higher than the boosted voltage (voltage of a boost H level) of the internal node N1 in the comparative example described above.

As described above, according to the present embodiment, the connection control signal SWj (voltage of the internal node N1 of the boost circuit 42*j*) to be applied to the gate terminal of the connection control transistor Mj as a switching element configuring (each demultiplexer 41*j* of) the demultiplexing circuit 40 can be increased as compared to the related art. Therefore, it is possible to realize an active matrix substrate corresponding to a monolithic DEMUX method while suppressing a size of the TFT as a switching element configuring the demultiplexing circuit as compared to the related art. Thus, in a display device of a monolithic DEMUX method using a TFT in which a channel layer is formed of a material with a relatively low mobility such as an oxide semiconductor, it is possible to further suppress an increase in a picture-frame size and to reduce power consumption.

2. Second Embodiment

Figure 8:
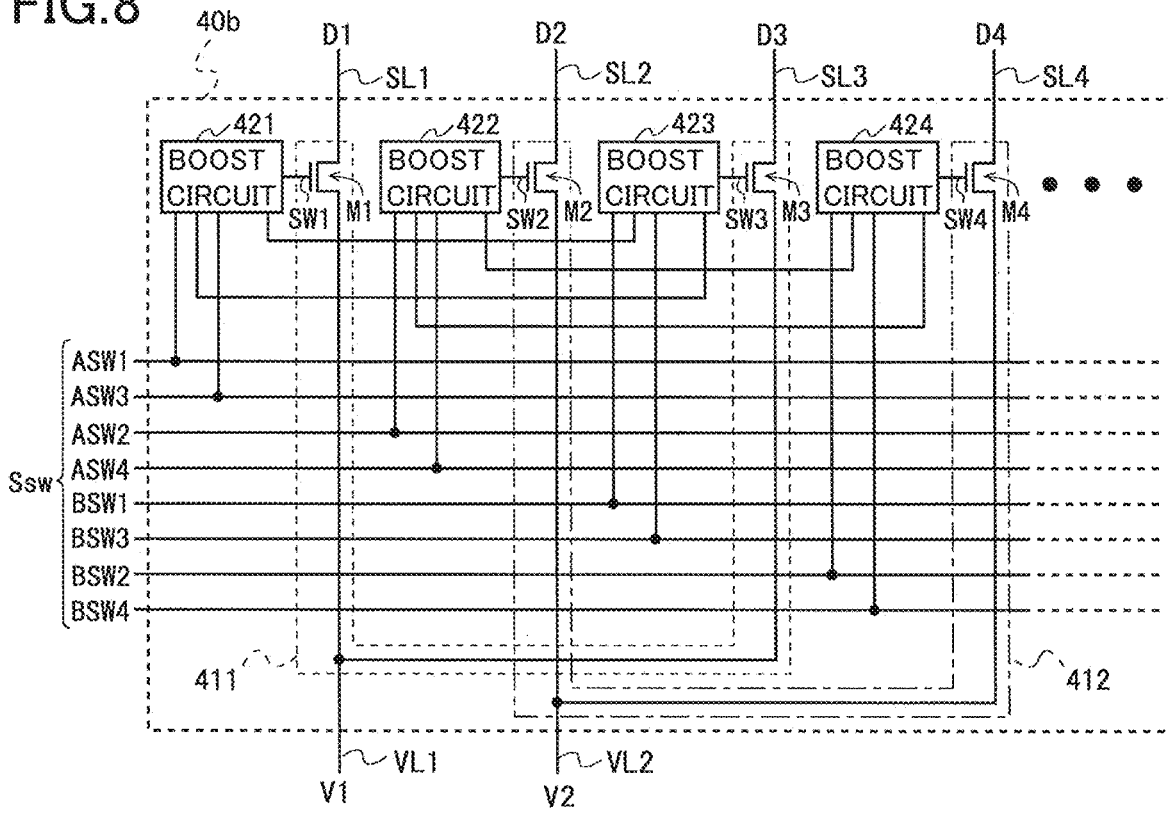
FIG. 8 is a circuit diagram illustrating a configuration of a demultiplexing circuit in an active matrix substrate according to a second embodiment.
Figure 9:
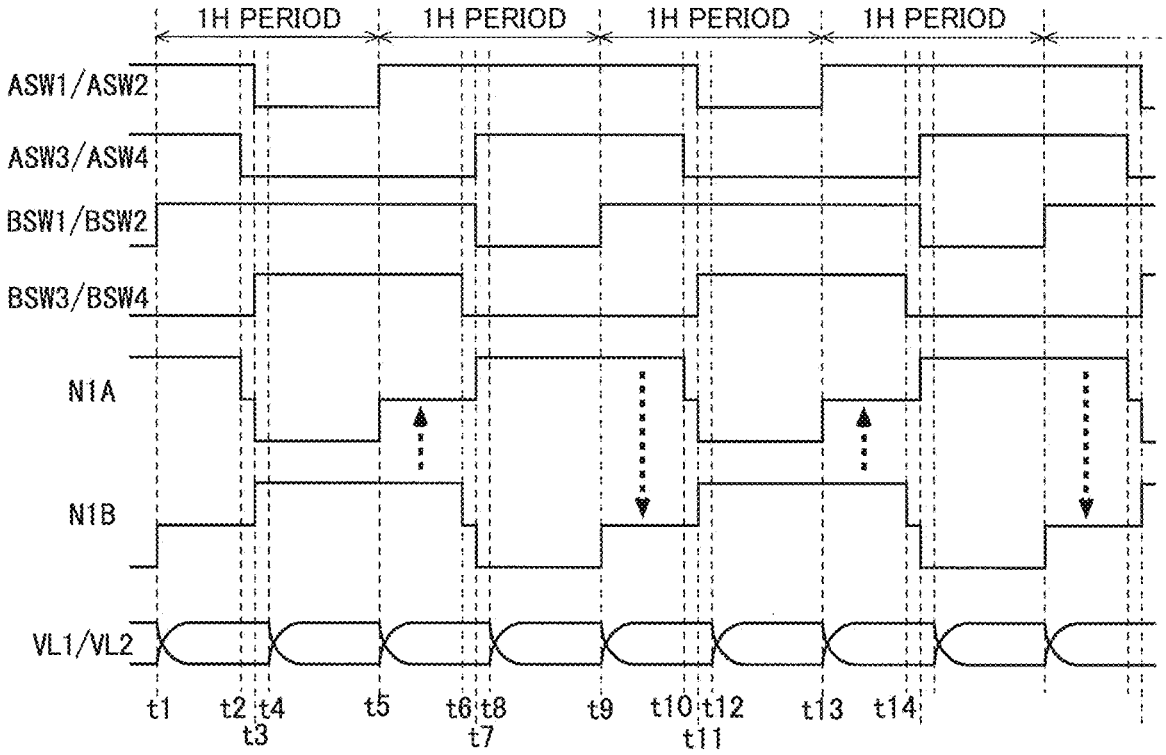
FIG. 9 is a signal waveform diagram illustrating an operation of a demultiplexing circuit in the active matrix substrate according to the second embodiment.

Next, a liquid crystal display device of a monolithic DEMUX method including an active matrix substrate according to a second embodiment is described. FIG. 8 is a circuit diagram illustrating a configuration of a demultiplexing circuit 40*b* in the active matrix substrate according to the present embodiment. FIG. 9 is a signal waveform diagram illustrating an operation of the demultiplexing circuit 40*b*. In a configuration of a liquid crystal display device (hereinafter, also referred to as a "display device according to the second embodiment") including the active matrix substrate according to the present embodiment, portions other than the demultiplexing circuit 40*b* are substantially the same as the configuration of the display device according to the first embodiment described above (see FIGS. 1 to 4), and thus, the same or corresponding portions are denoted by the same reference numerals and detailed description thereof is omitted.

As illustrated in FIG. 8, in the present embodiment, the demultiplexing control signal Ssw applied from the display control circuit 20 to the demultiplexing circuit 40*b* is configured by first to fourth A control signals ASW1 to ASW4 and first to fourth B control signals BSW1 to BSW4, and the demultiplexing circuit 40*b* is provided with eight signal lines for transmitting respectively the control signals ASW1 to ASW4 and BSW1 to BSW4. In the configuration illustrated in FIG. 8 in which the eight signal lines are used, the first and third A control signals ASW1 and ASW3 are input to the A boost circuit 421 of the first demultiplexer 411, and the second and fourth A control signals ASW2 and ASW4 are input to the A boost circuit 422 of the second demultiplexer 412. Further, the first and third B control signals BSW1 and BSW3 are input to the B boost circuit 423 of the first demultiplexer 411, and the second and fourth B control signals BSW2 and BSW4 are input to the B boost circuit 424 of the second demultiplexer 412. As described above, the "A boost circuit" is a boost circuit generating the connection control signal SWj to be applied to a gate terminal of the connection control transistor Mj with a smaller number among the two connection control transistors Mj and Mj+2 in each demultiplexer 41*j*, and the "B boost circuit" is a boost circuit generating the connection control signal SWj+2 to be applied to a gate terminal of the connection control transistor Mj+2 with a larger number among the two connection control transistors Mj and Mj+2 (the same applies to other embodiments to be described below). Since other configurations of the demultiplexing circuit 40*b* not described above are the same as the configuration of the demultiplexing circuit 40 according to the first embodiment described above (see FIGS. 2 and 8), the same portions are denoted by the same reference numerals.

In the present embodiment, as illustrated in FIG. 9, the demultiplexing control signal Ssw is generated by the display control circuit 20 such that the second and fourth A control signals ASW2 and ASW4 and the second and fourth B control signals BSW2 and BSW4 have the same waveforms as the first and third A control signals ASW1 and ASW3 and the first and third B control signals BSW1 and BSW3, respectively. In the demultiplexing circuit 40*b*, a boost circuit that applies the same control signal in the demultiplexing control signal Ssw among the boost circuits 421 to 42(2m) is divided into two boost circuit groups, and two signal lines are provided to respectively transmit the same control signal to the two boost circuit groups. For example, the first A control signal ASW1 and the second A control signal ASW2 are the same control signal as illustrated in FIG. 9, and signal lines for transmitting the first A control signal ASW1 as the same control signal to the boost circuits 421, 425, . . . , 42(2m−3) among the boost circuits 421, 422, 425, 426, . . . , 42(2m−3), 42(2m−2) that apply the controls signals, and signal lines for transmitting the second A control signal ASW2 as the same control signal to the boost circuits 422, 426, . . . , 42(2m−2) are provided for the same control signal, as illustrated in FIG. 8. As can be seen from this point and the configurations illustrated in FIGS. 2 and 8, in the present embodiment, the signals applied to the input terminals S1, S2, and Bst (see FIG. 3A) of each boost circuit 42*j* (j=1 to 2m) are substantially the same as the signals applied to the input terminals S1, S2, and Bst of each boost circuit 42*j* (j=1 to 2m) in the first embodiment.

Thus, according to the present embodiment, the demultiplexing circuit 40*b* operates in the same manner as the demultiplexing circuit 40 according to the first embodiment, and the same effect is obtained. In addition to this, according to the present embodiment, the number of signal lines for transmitting the demultiplexing control signal Ssw to the demultiplexers 411 to 41*m* increases, but a load per one signal line decreases (the number of boost circuits connected to one signal line is halved). Therefore, bluntness of waveforms of the control signals ASW1 to ASW4 and BSW1 to BSW4 configuring the demultiplexing control signal Ssw is reduced. As a result, generation of the data signals D1 to D2*m* by demultiplexing the multiplexed data signals Do1 to Dom as data side output signals from the source driver 30 and application to the source bus lines SL1 to SL2*m* are performed more accurately, and display quality on the display unit 101 is improved. Further, since the bluntness of the waveform is reduced, reaching a predetermined voltage at the time of precharging and boosting of the internal nodes N1A and N1B is made in a short time, and thus, high display quality can be obtained even in a panel with short one horizontal period, such as a high-resolution panel and a high-frequency drive panel.

In the configuration illustrated in FIG. 8, among the plurality (2m) of boost circuits in the demultiplexing circuit 40*b*, the boost circuits for applying the same control signal in a plurality of control signals configuring the demultiplexing control signal Ssw are grouped into two boost circuits, and two signal lines are provided to respectively transmit the same control signal to the two boost circuit groups. However, the present embodiment is not limited thereto, and among the plurality (2m) of boost circuits in the demultiplexing circuit 40, the boost circuits for applying the same control signal among the plurality of control signals are grouped into three or more boost circuit groups, and a configuration may be provided in which three or more signal lines are provided to respectively transmit the same control signal to the three or more boost circuit groups.

3. Third Embodiment

Figure 10:
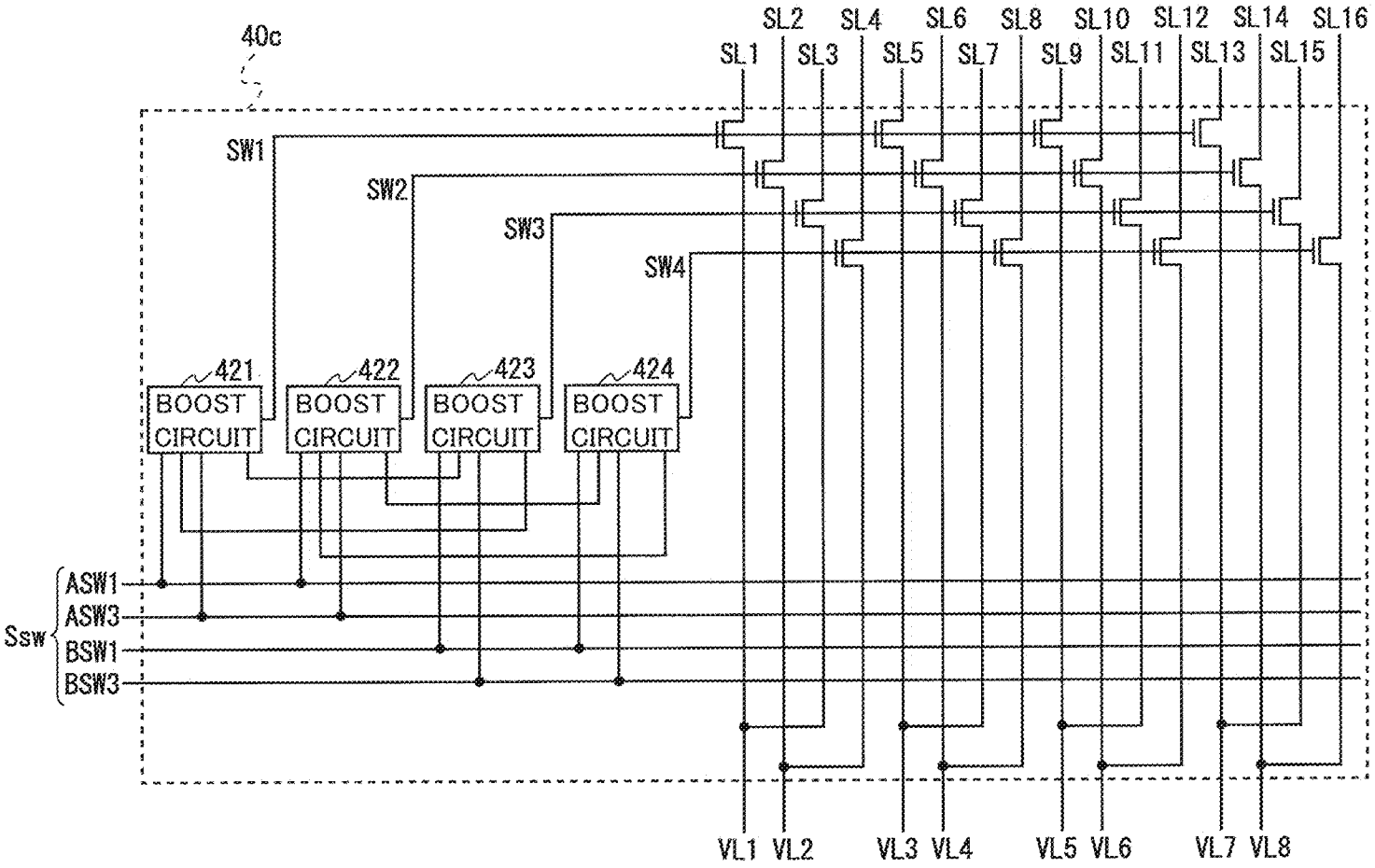
FIG. 10 is a circuit diagram illustrating a configuration of a demultiplexing circuit in an active matrix substrate according to a third embodiment.

Next, a monolithic DEMUX liquid crystal display device including the active matrix substrate according to the third embodiment is described. FIG. 10 is a circuit diagram illustrating a configuration of a demultiplexing circuit 40*c* in an active matrix substrate according to the present embodiment. In a configuration of a liquid crystal display device (hereinafter, also referred to as a "display device according to the third embodiment") including the active matrix substrate according to the present embodiment, portions other than the demultiplexing circuit 40*c* are substantially the same as the configuration of the display device according to the first embodiment described above (see FIG. 1 to FIG. 4), and thus, the same or corresponding portions are denoted by the same reference numerals and detailed description thereof is omitted.

In the demultiplexing circuit 40 according to the first embodiment described above, as illustrated in FIG. 2, a terminal N1 that outputs the connection control signal SWj as a voltage of the internal node N1 of each boost circuit 42*j* (j=1 to 2m) is connected to a gate terminal of the connection control transistor Mj as one switching element. However, as can be seen from the configuration of the demultiplexing circuit 40 illustrated in FIG. 2, the connection control signals SWj applied to gate terminals of the A connection control transistors Mj in the demultiplexers 411 to 41*m* are substantially the same signals, and, the connection control signals SWj+2 applied to the gate terminals of the B connection control transistors Mj+2 in the demultiplexers 411 to 41*m* are also substantially the same signals. Therefore, in the demultiplexing circuit 40*c* according to the present embodiment, as illustrated in FIG. 10, the terminals N1 outputting the connection control signals SWk as voltages of the internal nodes N1 of respective boost circuits 42*k* (k=1 to 4) are connected to the gate terminals of four connection control transistors as switching elements included in four different demultiplexers. According to the present embodiment, it is possible to reduce a circuit amount of the demultiplexing circuit while achieving the same effect as the first embodiment.

Although only 16 source bus lines SL1 to SL16 are illustrated in FIG. 10, in an actual active matrix substrate having a large number of source bus lines, four boost circuits are provided for the 16 source bus lines, and the connection control transistors respectively connected to the 16 source bus lines and the four boost circuits may be connected in the same form as the connection form illustrated in FIG. 10. In addition, the number of connection control transistors as switching elements that should give the same connection control signal from the terminal N1 that outputs the connection control signal SWk generated by each boost circuit 42*k* is more than 4 (2 to 3 or 5 or more). The above points are the same in third, fourth, seventh, and eighth embodiments to be described below (see FIG. 10, FIG. 11, FIG. 15, and FIG. 16).

4. Fourth Embodiment

The demultiplexing circuit 40*c* (FIG. 10) according to the third embodiment is a circuit in which the demultiplexing circuit 40 (FIG. 2) according to the first embodiment is modified such that output terminals N1 of the connection control signals SWk generated by each boost circuit 42*k* are connected to the gate terminals of the four connection control transistors as switching elements, but the demultiplexing circuit 40*b* (FIG. 8) according to the second embodiment may be modified such that the output terminals N1 of the connection control signals SWk generated by each boost circuit 42*k* are connected to the gate terminals of the four connection control transistors as switching elements. An active matrix substrate including the demultiplexing circuit is described as a fourth embodiment.

Figure 11:
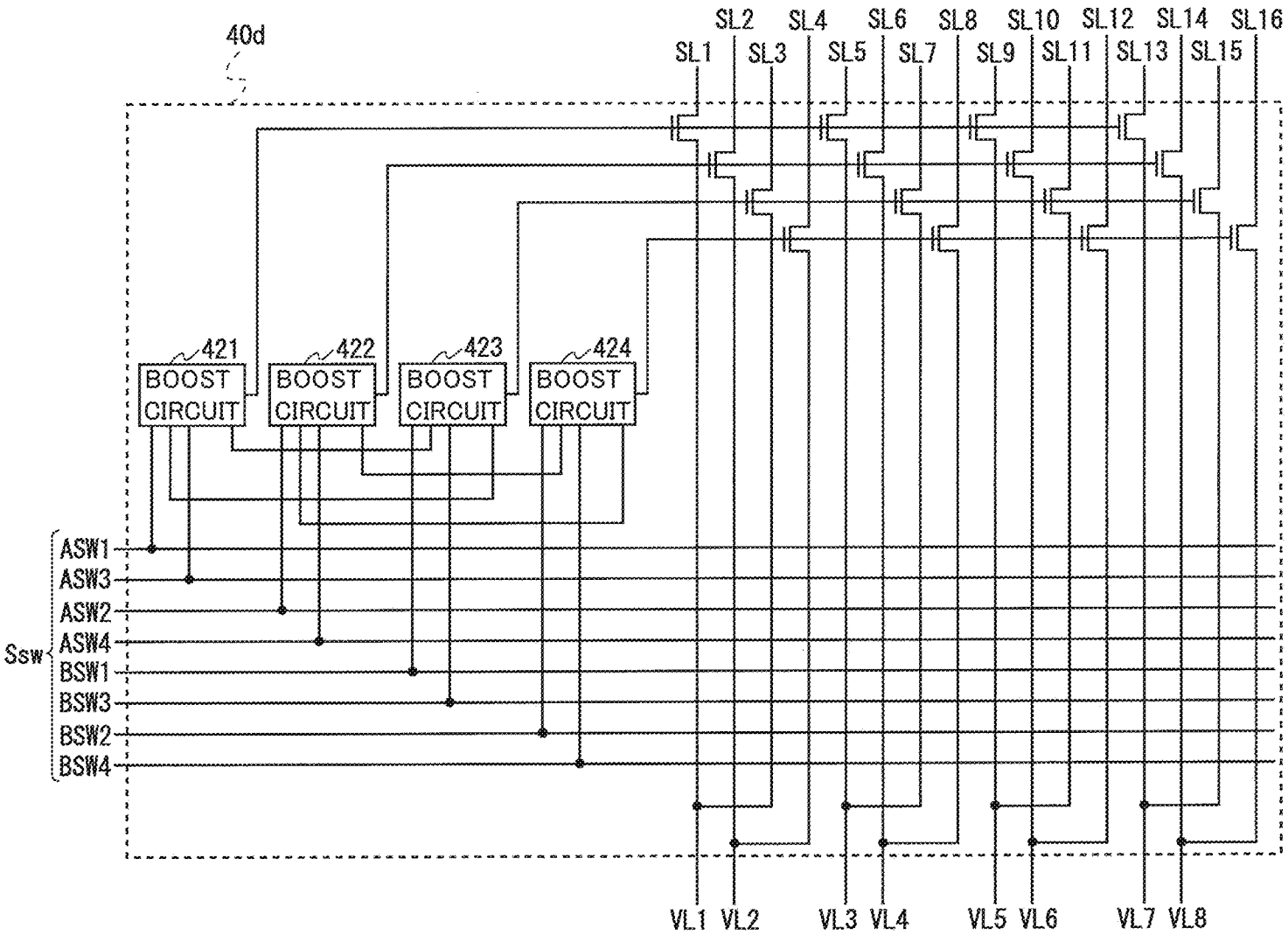
FIG. 11 is a circuit diagram illustrating a configuration of a demultiplexing circuit in an active matrix substrate according to a fourth embodiment.

FIG. 11 is a circuit diagram illustrating a configuration of a demultiplexing circuit 40*d* in an active matrix substrate according to the present embodiment. In a configuration of a liquid crystal display device of a monolithic DEMUX method (hereinafter, also referred to as a "display device according to the fourth embodiment") including the active matrix substrate according to the present embodiment, portions other than the demultiplexing circuit 40*d* are substantially the same as the configuration of the display device according to the first or the second embodiment (see FIG. 1 to FIG. 4 and FIG. 8), and thus, the same or corresponding portions are denoted by the same reference numerals and detailed description thereof is omitted.

As illustrated in FIG. 11, also in a demultiplexing circuit 40*d* according to the present embodiment, the demultiplexing control signal Ssw applied from the display control circuit 20 to the demultiplexing circuit 40*d* is configured by the first to fourth A control signals ASW1 to ASW4 and the first to fourth B control signals BSW1 to BSW4, and the demultiplexing circuit 40*d* is provided with eight signal lines for respectively transmitting the control signals ASW1 to ASW4 and BSW1 to BSW4, in the same manner as in the second embodiment (see FIG. 8). The second and fourth A control signals ASW2, and ASW4 and the second and fourth B control signals BSW2 and BSW4 have the same waveforms as the first and third A control signals ASW1 and ASW3 and the first and third B control signals BSW1 and BSW3, respectively (see FIG. 9). However, in the demultiplexing circuit 40*d* according to the present embodiment, output terminals N1 of the connection control signals SWk generated by the respective boost circuits 42*k* (k=1 to 4) are connected to the gate terminals of the four connection control transistors as switching elements respectively included in the four demultiplexer different from each other, as illustrated in FIG. 11. According to the present embodiment described above, it is possible to reduce a circuit amount of the demultiplexing circuit while achieving the same effect as the second embodiment.

5. Fifth Embodiment

Figure 12:
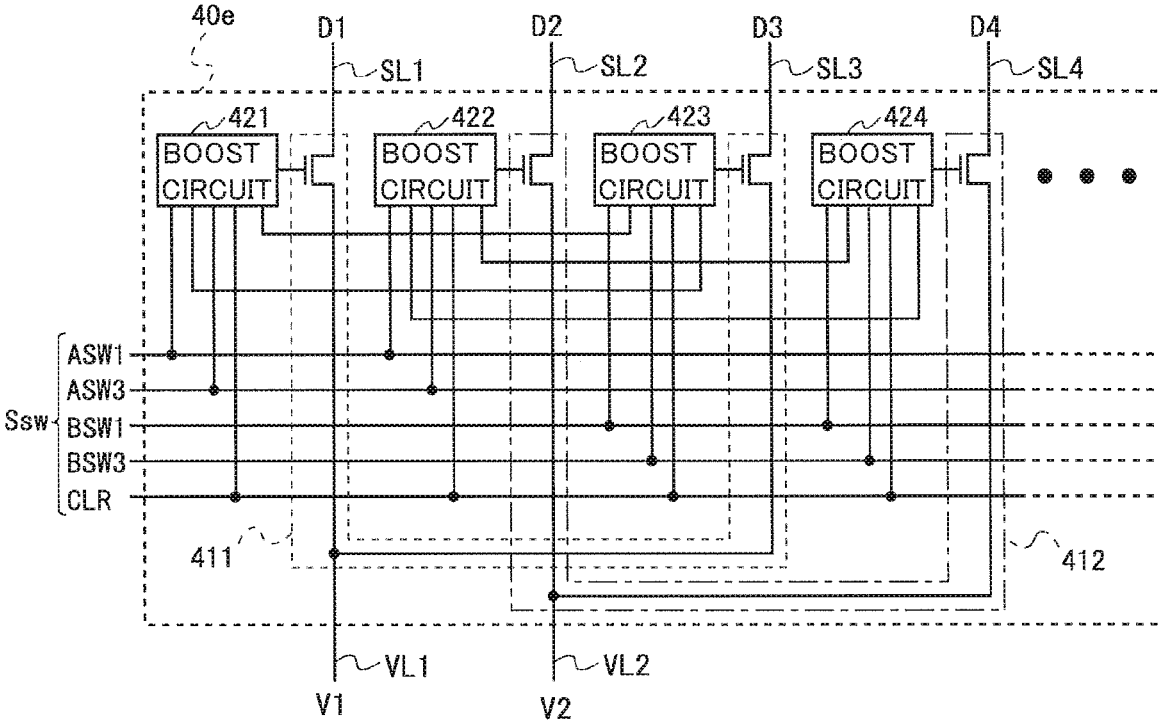
FIG. 12 is a circuit diagram illustrating a configuration of a demultiplexing circuit in an active matrix substrate according to a fifth embodiment.
Figure 13A:
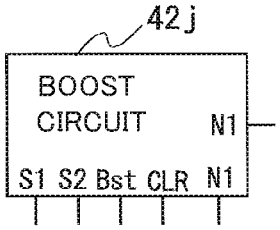
FIGS. 13A and 13B are diagrams illustrating a configuration of a boost circuit included in the demultiplexing circuit illustrated in FIG. 12.
Figure 13B:
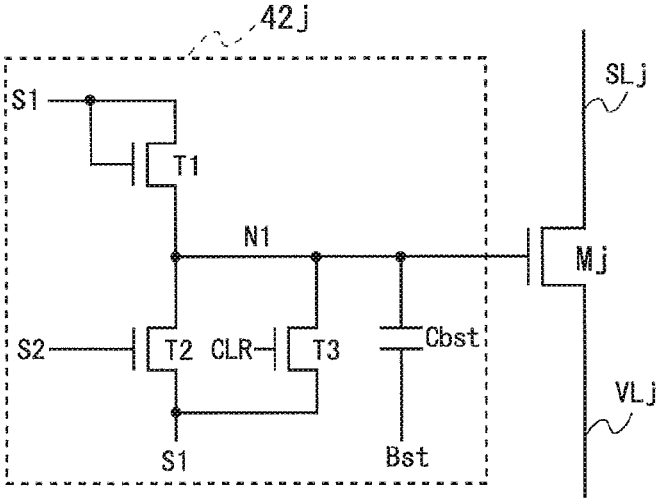

Next, a liquid crystal display device of a monolithic DEMUX method including an active matrix substrate according to a fifth embodiment is described. FIG. 12 is a circuit diagram illustrating a configuration of a demultiplexing circuit 40*e* in the active matrix substrate according to the present embodiment. FIG. 13A is a diagram illustrating terminals of boost circuit 42*j* included in the demultiplexing circuit 40*e*, and FIG. 13B is a circuit diagram illustrating a configuration of the boost circuit 42*j* (j=1 to 2m). In a configuration of a liquid crystal display device (hereinafter, also referred to as a "display device according to the fifth embodiment") including the active matrix substrate according to the present embodiment, portions other than the demultiplexing circuit 40*e* are substantially the same as the configuration of the display device according to the first embodiment (see FIG. 1 and FIG. 2), and thus, the same or corresponding portions are denoted by the same reference numerals and detailed description thereof is omitted. Hereinafter, a configuration and an operation of the boost circuit 42*j* and an operation of the demultiplexing circuit 40*e* are described below with reference to FIG. 12 and FIG. 13.

As illustrated in FIG. 12, in the present embodiment, the demultiplexing control signal Ssw applied from the display control circuit 20 to the demultiplexing circuit 40*e* includes a clear signal CLR in addition to the two A control signals ASW1 and ASW3 and the two B control signals BSW1 and BSW2, and the demultiplexing circuit 40*e* is provided with signal lines for respectively transmitting the two A control signals ASW1 and ASW3, the two B control signals BSW1 and BSW2, and the clear signal CLR. The clear signal CLR and the A control signals ASW1 and ASW2 are input to the boost circuit 42*j* generating the A connection control signal SWj to be applied to a gate terminal of the A connection control transistor (a connection control transistor with a smaller number) Mj of the two connection control transistors Mj and Mj+2 included in each demultiplexer 41*k*, and the clear signal CLR and the B control signals BSW1 and BSW2 are input to the boost circuit 42(*j*+2) generating the B connection control signal SWj+2 to be applied to a gate terminal of the B connection control transistor (a connection control transistor with a larger number) Mj+2 of the two connection control transistors Mj and Mj+2.

As illustrated in FIG. 13A, the boost circuit 42*j* (j=1 to 2m) has a fourth input terminal CLR in addition to the first to third input terminals S1, S2, and Bst as input terminals, has first and second output terminals N1 and N1 as output terminals, and is configured as illustrated in FIG. 13B. That is, the boost circuit 42*j* includes two transistors T1 and T2, which are N-channel type TFTs, and a boost capacitor Cbst that are connected in the same connection form as in the boost circuit 42*j* according to the first embodiment. In addition to this, the boost circuit 42*j* according to the present embodiment further includes a transistor T3 which is an N-channel type TFT, the transistor T3 functions as an initialization switching element, and the internal node N1 including a connection point between the transistors T1 and T2 is connected to the first input terminal S1 via the transistor T3. A gate terminal of the transistor T3 is connected to a fourth input terminal CLR. Further, in the same manner as the boost circuit 42*j* according to the first embodiment (see FIG. 3), the internal node N1 is connected to the first and second output terminals N1 and N1, and a voltage of the internal node N1 is applied to the connection control transistor Mj (j=1 to 2m) as the connection control signal (the A connection control signal or the B connection control signal) SWj.

The clear signal CLR applied to each boost circuit 42*j* goes to a high level for a predetermined period at an end point in time of each frame period or immediately before a start point in time of each frame period, and the internal nodes N1 in each boost circuit 42*j* are initialized by the clear signal CLR of an H level. Thereby, the operation of the demultiplexing circuit 40*e* is stabilized.

The demultiplexing circuit 40*e* according to the present embodiment including the boost circuit 42*j* described above operates in the same manner as the demultiplexing circuit 40 according to the first embodiment except initialization of the internal node N1 made by the clear signal CLR. According to the present embodiment, it is possible to stabilize the operation of the demultiplexing circuit 40*e* while achieving the same effect as the first embodiment.

6. Sixth Embodiment

The demultiplexing circuit 40*e* (FIG. 12) according to the fifth embodiment is a circuit in which each boost circuit 42*j*

(FIG. 3) in the demultiplexing circuit 40*b* (FIG. 2) according to the first embodiment is modified to the boost circuit 42*j* having a configuration illustrated in FIG. 13, but each boost circuit 42*j* (FIG. 3) may be modified to the boost circuit 42*j* illustrated in FIG. 13, in the demultiplex circuit 40*b* (FIG. 8) according to the second embodiment. An active matrix substrate including the demultiplexing circuit is described as a sixth embodiment.

Figure 14:
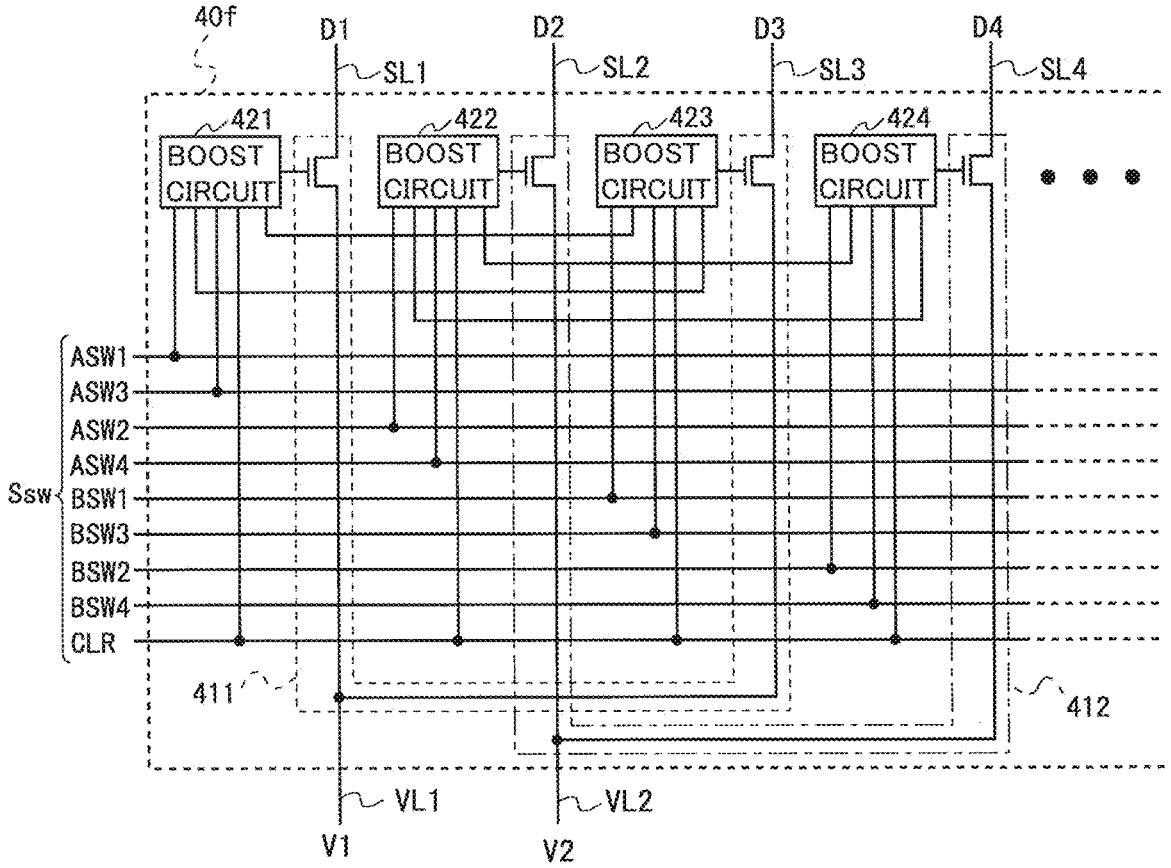
FIG. 14 is a circuit diagram illustrating a configuration of a demultiplexing circuit in an active matrix substrate according to a sixth embodiment.

FIG. 14 is a circuit diagram illustrating a configuration of a demultiplexing circuit 40*f* in the active matrix substrate according to the present embodiment. In a configuration of a liquid crystal display device of a monolithic DEMUX method (hereinafter, also referred to as a "display device according to the sixth embodiment") including the active matrix substrate according to the present embodiment, portions other than the demultiplexing circuit 40*f* is substantially the same as the configuration of the display device according to the first or second embodiment (see FIG. 1 to FIG. 4 and FIG. 8), and thus, the same or corresponding portions are denoted by the same reference numerals and detailed description thereof is omitted.

In the present embodiment, the clear signal CLR applied to each boost circuit 42*j* goes to an H level for a predetermined period at an end point in time of each frame period or immediately before a start point in time of each frame period, and the internal nodes N1 in each boost circuit 42*j* are initialized by the clear signal CLR of an H level, in the same manner as the fourth embodiment.

According to the present embodiment described above, it is possible to stabilize the operation of the demultiplexing circuit 40*f* while achieving the same effect as the second embodiment.

7. Seventh Embodiment

Figure 15:
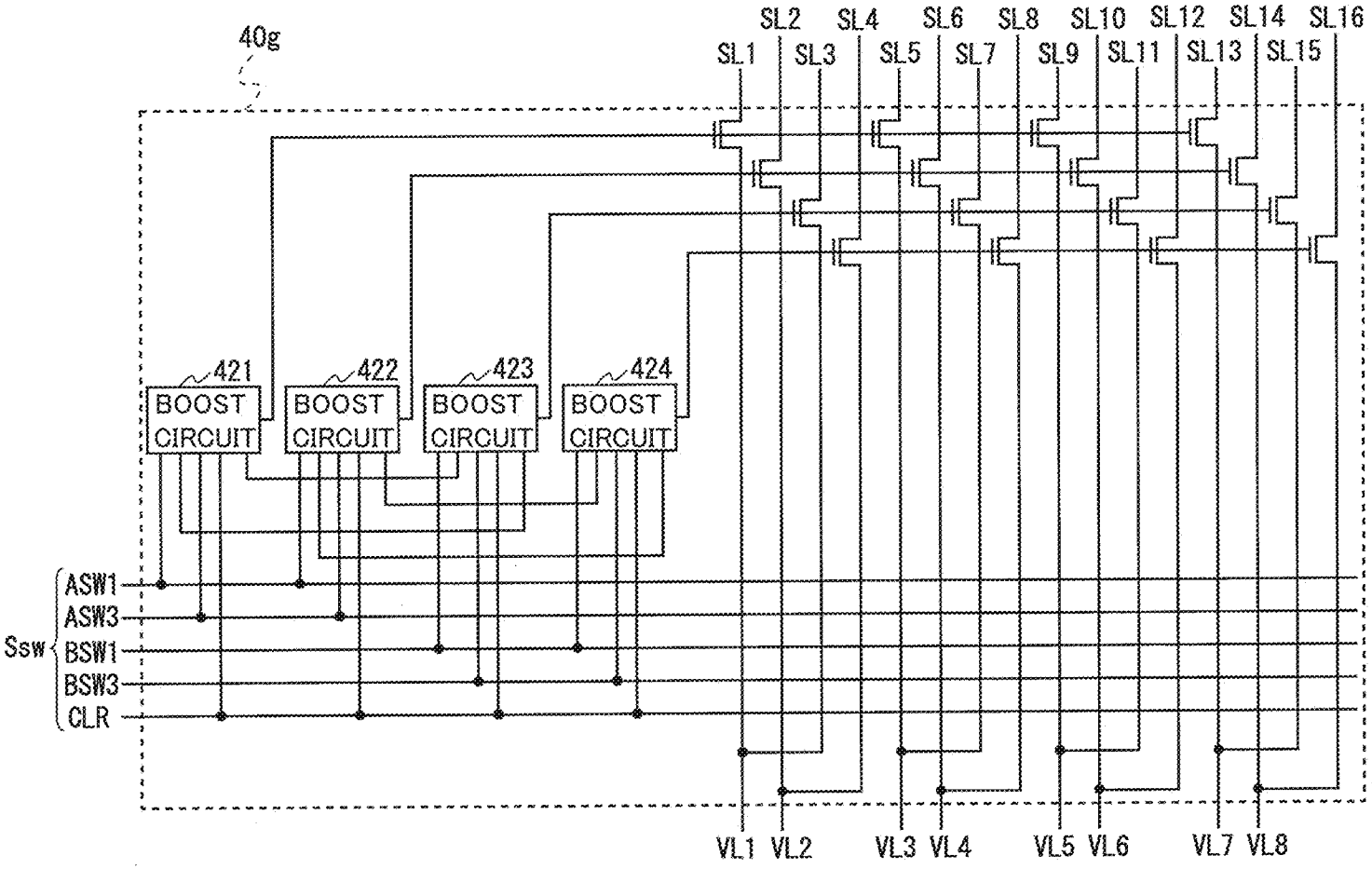
FIG. 15 is a circuit diagram illustrating a configuration of a demultiplexing circuit in an active matrix substrate according to a seventh embodiment.

FIG. 15 is a circuit diagram illustrating a configuration of a demultiplexing circuit 40*g* in an active matrix substrate according to the present embodiment. The demultiplexing circuit 40*g* is a circuit in which each boost circuit 42*j* (FIG. 3) in the demultiplexing circuit 40*c* (FIG. 10) according to the third embodiment is modified to a boost circuit 42*j* having a configuration illustrated in FIG. 13. In a configuration of a liquid crystal display device of a monolithic DEMUX method (hereinafter, also referred to as a "display device according to the seventh embodiment") including the active matrix substrate according to the present embodiment, portions other than the demultiplexing circuit 40*g* are substantially the same as the configuration of the display device (see FIG. 1 to FIG. 4 and FIG. 10), and thus, the same or corresponding portions are denoted by the same reference numerals and detailed description thereof is omitted.

In the present embodiment, the clear signal CLR applied to each boost circuit 42*j* also goes to an H level for a predetermined period at an end point in time of each frame period or immediately before a start point in time of each frame period, and the internal nodes N1 in each boost circuit 42*j* are initialized by the clear signal CLR of an H level, in the same manner as the fifth embodiment.

According to the present embodiment described above, it is possible to stabilize the operation of the demultiplexing circuit 40*g* while achieving the same effect as the third embodiment.

8. Eighth Embodiment

Figure 16:
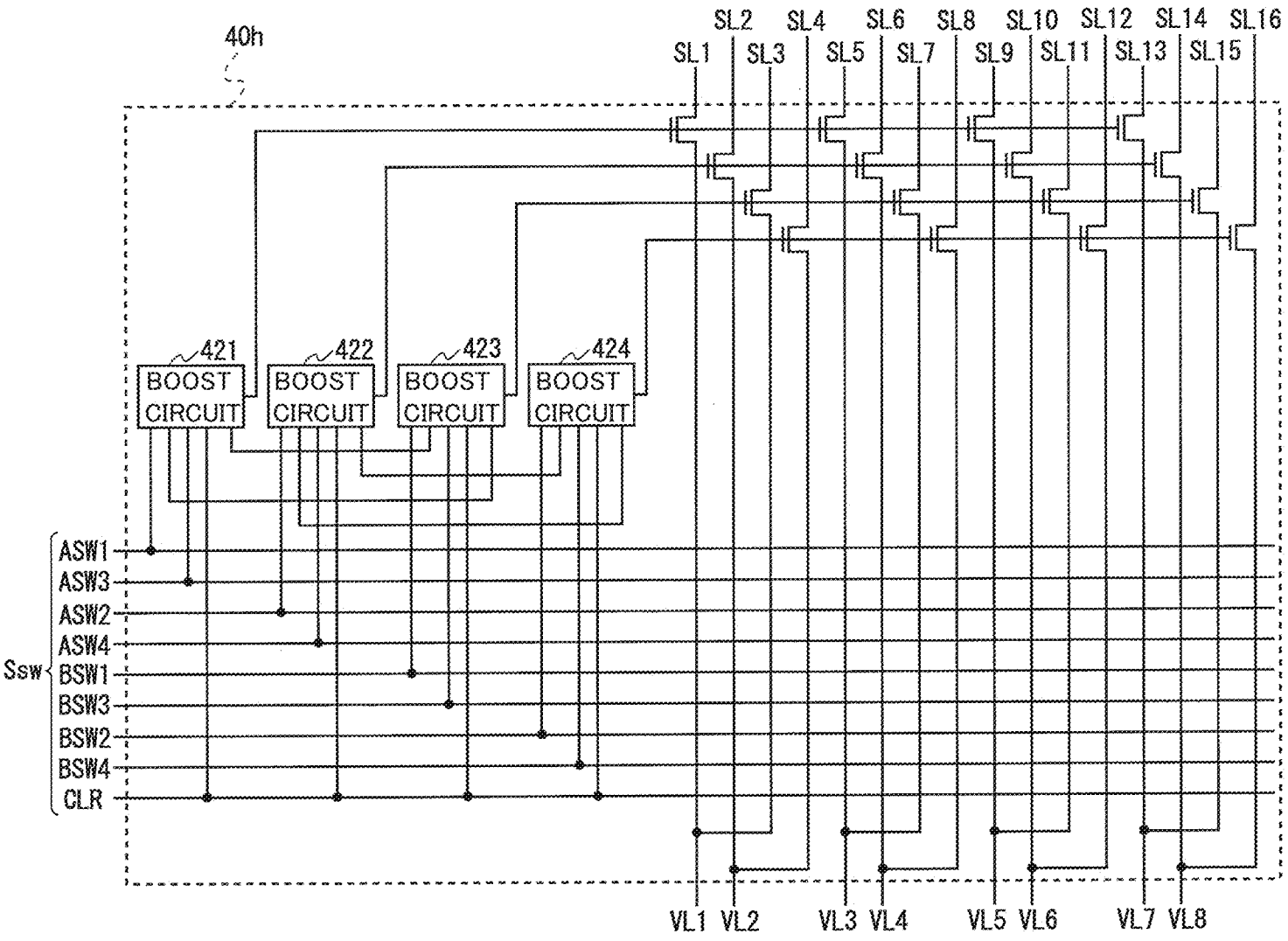
FIG. 16 is a circuit diagram illustrating a configuration of a demultiplexing circuit in an active matrix substrate according to an eighth embodiment.

FIG. 16 is a circuit diagram illustrating a configuration of a demultiplexing circuit 40*h* in an active matrix substrate according to the present embodiment. The demultiplexing circuit 40*h* is a circuit in which each boost circuit 42*j* (FIG. 3) in the demultiplexing circuit 40*d* (FIG. 11) according to the fourth embodiment is modified to a boost circuit 42*j* having a configuration illustrated in FIG. 13. In a configuration of a liquid crystal display device of a monolithic DEMUX (hereinafter, also referred to as a "display device according to the eighth embodiment") including the active matrix substrate according to the present embodiment, the portion other than the demultiplexing circuit 40*h* are substantially the same as the configuration of the display device according to the fourth embodiment (see FIG. 1 to FIG. 4 and FIG. 11), and thus, the same or corresponding portions are denoted by the same reference numerals and detailed description thereof is omitted.

In the present embodiment, the clear signal CLR applied to each boost circuit 42*j* also goes to an H level for a predetermined period at an end point in time of each frame period or immediately before a start point in time of each frame period, and the internal nodes N1 in each boost circuit 42*j* are initialized by the clear signal CLR of an H level, in the same manner as the fifth embodiment.

According to the present embodiment described above, it is possible to stabilize the operation of the demultiplexing circuit 40*h* while achieving the same effect as the fourth embodiment.

9. Ninth Embodiment

Next, a liquid crystal display device of a monolithic DEMUX method (hereinafter, also referred to as a "display device according to the present embodiment" or a "display device according to a ninth embodiment") including the active matrix substrate according to the ninth embodiment is described. In the display device according to the present embodiment, a so-called in-cell touch panel is configured by using the active matrix substrate according to the present embodiment. The display device according to the present embodiment has the same configuration as the display device according to the first embodiment except that an in-cell touch panel is configured by using an active matrix substrate and a control operation of a gate driver and a source driver that drive the in-cell touch panel. Therefore, hereinafter, in the configuration of the display device according to the present embodiment, portions which is the same as or corresponding to the configuration of the display device according to the first embodiment (FIG. 1 to FIG. 4) are denoted by the same reference numerals, and detailed description thereof is omitted.

Figure 17:
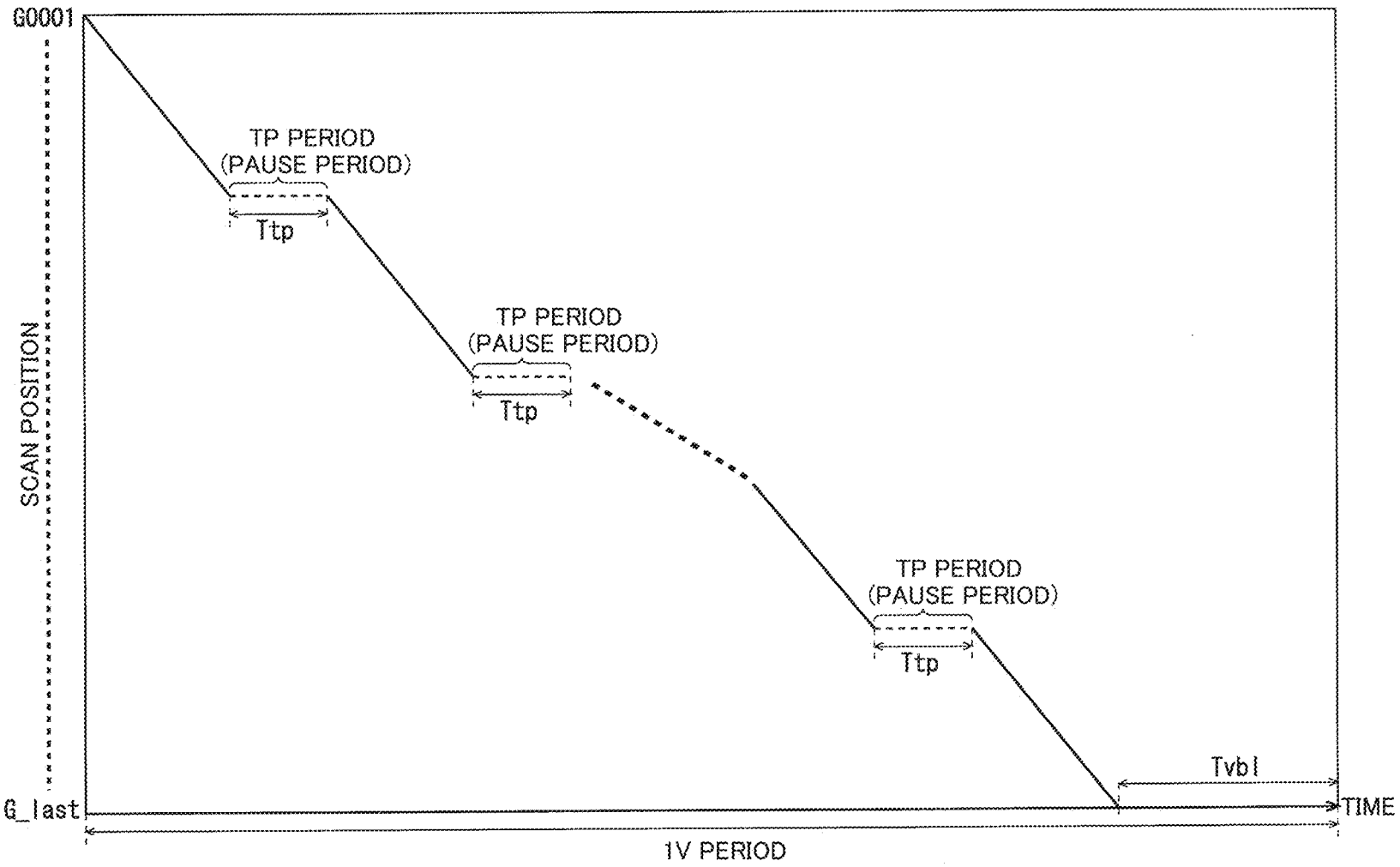
FIG. 17 is a timing chart illustrating an operation of a display device including an active matrix substrate according to a ninth embodiment.

FIG. 17 is a timing chart schematically illustrating a scan operation, that is, drive of the gate bus lines GL1 to GLn in the display device according to the present embodiment. Generally, in an active matrix type display device, in each frame period (also referred to as "1V period"), the gate bus lines GL1 to GLn are driven to be sequentially selected in order to write data necessary for displaying an image of one frame, and In conjunction with this, a drive of the source bus lines SL1 to SL2*m* (application of the data signals D1 to D2*m* to the source bus lines SL1 to SL2*m*) is performed (hereinafter, the drive is referred to as an "image writing drive"). In a configuration including the in-cell touch panel like the display device according to the present embodiment, as illustrated in FIG. 17, a period (hereinafter, referred to as a "TP period") Ttp for detecting a touch position in each frame period is provided, and in the TP period Ttp, the touch position of the touch panel is detected in a state where the drive of the gate bus lines GL1 to GLn and the source bus lines SL1 to SL2*m* is stopped. A configuration and an operation for the touch position detection are well known and are not directly related to characteristics of the present embodiment, and thus, description thereof is omitted.

In FIG. 17, a vertical axis represents a scan position and a horizontal axis represents time. More specifically, scan positions G0001 to G_last denoted on the vertical axis indicate positions of the gate bus lines GL1 to GLn, respectively. Further, in FIG. 17, a solid line extending obliquely indicates a scan position (a position of the selected gate bus line GLi) at each point in time of the 1V period (one frame period), and a dotted line extending in a horizontal direction (a horizontal direction in the figure) Indicates a period in which the drive (more accurately, the image writing drive) of the gate bus line for detecting a touch position is halted, that is, the TP period Ttp. The solid line extending in the horizontal direction indicates a vertical blanking period Tvbl.

Figure 18:
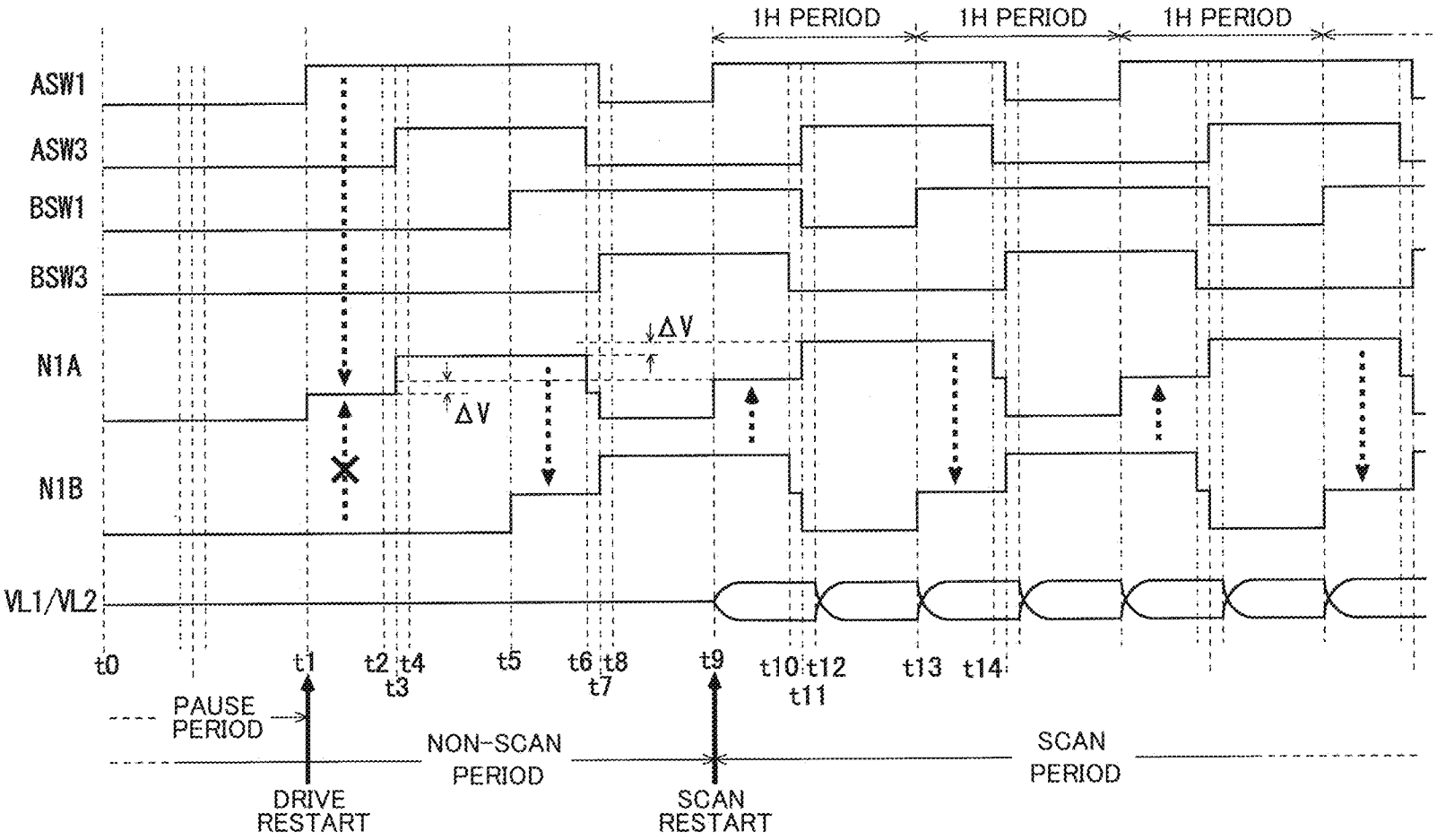
FIG. 18 is a signal waveform diagram illustrating an operation of a demultiplexing circuit in the active matrix substrate according to the ninth embodiment.

FIG. 18 is a signal waveform diagram illustrating an operation of the demultiplexing circuit 40 according to the present embodiment, and illustrates a change in the demultiplexing control signal Ssw (A control signals ASW1 and ASW3 and B control signals BSW1 and BSW3) when the image writing drive is restarted from the state where the image writing drive is halted in the TP period Ttp, a change in a voltage of an internal node N1A of an A boost circuit 42*j*, a change in a voltage of an internal node N1B of a B boost circuit 42(*j*+2), and a change in voltages of data output lines VL1 and VL2 (multiplexed data signals Do1 and Dot output from the source driver 30).

In the example illustrated in FIG. 18, before a time t1, the image writing drive (a drive of the source bus line and a drive of the gate bus line) is halted in a pause period, and the control signals ASW1, ASW3, BSW1, and BSW3 configuring the activation control signal Ssw applied to the demultiplexing circuit 40 are all at an L level (inactive), and the internal nodes N1A and N1B of the boost circuits 421 to 42(2m) are all at an L level. At the time t1, the pause period for the TP period Ttp ends, and the demultiplexing circuit 40 restarts an operation based on the demultiplexing control signal Ssw. Specifically, at the time t1, one A control signal ASW1 of the demultiplexing control signals Ssw changes from an L level to an H level, and in the A boost circuit 42*j*, a voltage of the H level is applied to the internal node N1A via a transistor T1A of a diode-connected form (see FIG. 4A).

However, at the time t1, a voltage of the internal node N1B of the B boost circuit 42(*j*+2) is at an L level, and thus, the transistor T2A in the A boost circuit 42*j* remains to be turned off. Therefore, as illustrated in FIG. 18, the voltage (a precharge voltage) of the internal node N1A of the A boost circuit 42*j* is lower than a normal precharge voltage (a voltage of an H level of the A control signal ASW1) by a voltage ΔV corresponding to a threshold voltage of the transistor T1 of a diode-connected form. Therefore, after the other A control signal ASW3 of the demultiplexing control signal Ssw changes to an H level in a subsequent time t3 and thereby the voltage of the internal node N1A of the A boost circuit 42*j* is boosted (see FIG. 4A), the voltage (a voltage of a boost H level) of the internal node N1A also becomes lower than a voltage of a normal boost H level by the voltage ΔV. As such, if the demultiplexing circuit 40 is operated by using the voltage of the internal node N1A lower than usual as the connection control signal SWj, there is a possibility that a demultiplexing operation (an operation for distributing each multiplexed data signal Dok (k=1 to m) to the corresponding source bus lines SLj and SLj+2) is not performed properly. In contrast to this, in the present embodiment, as illustrated in FIG. 18, not only the pause period but also a period from the end point in time t1 of the pause period to a time t9 to be described below are a non-scan period, and during this, the gate bus lines GL1 to GLn are not driven (the gate bus lines GL1 to GLn remain in a non-selection state).

As illustrated in FIG. 18, at a time t5, one B control signal BSW1 of the demultiplexing control signals Ssw changes to an H level, and thereby, the internal node N1B of the B boost circuit 42(*j*+2) is precharged. At this time, a voltage of the internal node N1A of the A boost circuit 42*j* is at a boost H level. The voltage of the internal node N1A is lower than the voltage of a normal boost H level by ΔV as described above but is sufficiently higher than a voltage of an H level of the B control signal BSW1. Therefore, in the B boost circuit 42(*j*+2), the internal node N1B is precharged by the voltage of an H level of the B control signal BSW1 via the transistor T2B which is turned on by the voltage of the internal node N1A (see FIG. 4B). Therefore, the voltage of the internal node N1B of the B boost circuit 42(*j*+2) increases to a normal precharge voltage. As a result, if the other B control signal BSW3 of the demultiplexing control signal Ssw changes to an H level at a subsequent time t7 and thereby the voltage of the internal node N1B of the B boost circuit 42(*j*+2) is boosted (see FIG. 4B), the voltage of the internal node N1B increases to the voltage of the normal boost H level.

In the present embodiment, as illustrated in FIG. 18, the drive of the gate bus lines GL1 to GLn is restarted at a time t9 while the voltage of the internal node N1B of the B boost circuit 42(*j*+2) is at the normal boost H level as described above. That is, scan for the image writing drive is restarted. At the time t9, an output of the multiplexed data signals Do1 to Dom from the source driver 30 to the data output lines VL1 to VLm restarts, and drive of the source bus lines SL1 to SL2*m* also restarts. After the end time t1 of the pause period and before the drive of the gate bus lines GL1 to GLn restarts (before restart of scan), if a boost operation of the voltage of the internal node N1 is performed at least once by any of the boost circuits 42*j*, the drive of the source bus lines SL1 to SL2*m* may restart before the drive of the gate bus lines GL1 to GLn restarts.

In the present embodiment, the display control circuit 20 is configured to control the demultiplexing circuit 40, the gate drivers 51 and 52, and the source driver 30 as described above, and thus, also in a display device having a pause period (the TP period Ttp) in which scan is halted like a display device including a touch panel, an effect is obtained in which the same operation as in the first embodiment is performed while ensuring a proper operation of the demultiplex circuit 40.

In the present embodiment, the in-cell touch panel is configured by using the active matrix substrate according to the first embodiment, but the in-cell touch panel may be configured by using the active matrix substrate according to another embodiment (any one of the second to eighth embodiments). Even in the configuration, the same effect as in other embodiments is obtained while ensuring a proper operation of a demultiplexing circuit. When the active matrix substrates according to the fifth to eighth embodiments are used, an internal node of a boost circuit may be initialized by the clear signal CLR at a start point in time of a pause period. Thereby, it is possible to pause an operation of a demultiplexing circuit more reliably during a pause period.

In the present embodiment, as illustrated in FIG. 17 and FIG. 18, a liquid crystal display device of a monolithic DEMUX method including an in-cell touch panel has characteristics in a configuration for restarting scan immediately after a pause period for detecting a touch position. However, this configuration, that is, a configuration in which a boost operation of a demultiplexing circuit is performed at least once before scan restarts from a pause period, is also effective as a configuration for restarting a pause period as a non-scan period even in a display device of a monolithic DEMUX method (a display device that performs a so-called pause drive) that drives a liquid crystal panel such that scan periods and non-scan periods appear alternately to reduce power consumption. Further, the configuration is also effective as a configuration for starting scan after power is supplied in a liquid crystal display device of a monolithic DEMUX method. Furthermore, even at a start time of each frame period, the demultiplexing control signals Ssw (ASW1, ASW3, BSW1, and BSW3) that normally control the demultiplexing circuit have waveforms illustrated in FIG. 18, and thus, a configuration is effective in which a boost operation of the demultiplexing circuit is performed at least once up to start scan (drive of the gate bus lines GL1 to GLn) from the start of each frame period.

10. Modification Example

Although the present invention is described in detail above, the above description is illustrative in all aspects and is not restrictive. It is understood that numerous other modifications and changes can be devised without departing from the scope of the present invention.

For example, in an active matrix substrate according to the respective embodiments described above, the demultiplexing circuit is realized by using only N-channel type TFTs but is not limited thereto. For example, a circuit such as the demultiplexing circuit in the active matrix substrate according to the respective embodiments described above may be realized by using only P-channel type TFTs. In this case, a configuration relating to a polarity of a voltage is different from the configurations of the respective embodiments described above, but since a specific configuration thereof is apparent to those skilled in the art, details thereof are omitted.

Further, in the respective embodiments described above, it is premised that the active matrix substrate according to the embodiment is used in a liquid crystal display device, and one set of source bus line groups corresponding to the respective demultiplexers 41*k* or the respective output terminals Tok of the source driver 30 is configured by two source bus lines SLj and SLj+2 selected every other source bus line in consideration of an inversion drive (a column inversion drive or the like) (see FIG. 2 and FIG. 8), but is not limited thereto. For example, the set of source bus lines corresponding to the respective demultiplexers 41*k* (k=1 to m) may be configured by two source bus lines SLj and SLj+1 adjacent to each other. Further, the set of source bus lines corresponding to the respective demultiplexers 41*k* may be configured by three or more source bus lines.

The present invention can be applied to display devices other than liquid crystal display devices, for example, organic electroluminescence (EL) display devices, as long as the display devices are display devices of a monolithic DEMUX method using an active matrix substrate. When the present invention is applied to organic EL display devices, an inversion drive is not performed, and thus, a demultiplexing circuit may have a configuration in which source bus lines are grouped into a plurality of sets, each set including two or more source bus lines adjacent to each other (for example, three source bus lines corresponding to three primary colors of color display), and each set of the source bus lines corresponds to one demultiplexer 41*k* or one output terminal Tok of the source driver 30.

What is claimed is:

1. An active matrix substrate comprising:

a plurality of data signal lines;

a plurality of scan signal lines intersecting the plurality of data signal lines;

a plurality of pixel formation portions arranged along the plurality of data signal lines and the plurality of scan signal lines; and a demultiplexing circuit that includes a plurality of demultiplexers respectively corresponding to a plurality of sets of data signal lines obtained by grouping the plurality of data signal lines, each set including two or more data signal lines, and includes a plurality of input terminals respectively corresponding to the plurality of demultiplexers, wherein each of the plurality of demultiplexers includes two or more connection control switching elements respectively corresponding to the two or more data signal lines in a corresponding set that is one of the plurality of sets of data signal lines and corresponds to the each of the plurality of demultiplexers, in each of the plurality of demultiplexers, first conduction terminals of the two or more connection control switching elements are all connected to corresponding input terminals, and second conduction terminals of the two or more connection control switching elements are respectively connected to the two or more data signal lines of the corresponding set, the demultiplexing circuit includes a plurality of boost circuits that generate connection control signals to be applied to control terminals of the connection control switching elements included in the plurality of demultiplexers, each of the plurality of boost circuits:

includes an internal node connected to a control terminal of a connection control switching element to which a connection control signal to be generated is applied, and a charging/discharging switching element for charging and discharging the internal node, and is configured to boost a voltage applied to the internal node via the charging/discharging switching element and to apply, as the connection control signal, a boosted voltage of the internal node to the control terminal of the connection control switching element, and the demultiplexing circuit is configured such that, when a charging/discharging switching element in any of the plurality of boost circuits is switched on, a boosted voltage of an internal node in another boost circuit is applied to a control terminal of the charging/discharging switching element.

2. The active matrix substrate according to claim 1, wherein the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and wherein the active matrix substrate further includes two or more signal lines for respectively transmitting the same control signal to the two or more boost circuit groups.

3. The active matrix substrate according to claim 1, wherein an internal node of one boost circuit of the plurality of boost circuits is connected to control terminals of two or more connection control switching elements to which the same connection control signal is applied among connection control switching elements in the plurality of demultiplexers.

4. The active matrix substrate according to claim 3, wherein the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and wherein the active matrix substrate further includes two or more signal lines for respectively transmitting the same control signal to the two or more boost circuit groups.

5. The active matrix substrate according to claim 1, wherein each of the plurality of boost circuits further includes an initialization switching element for initializing a voltage of the internal node at an end time of each frame period, immediately before start of each frame period, or at an halt time of a drive of the plurality of data signal lines and a drive of the plurality of scan signal lines.

6. The active matrix substrate according to claim 5, wherein the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and wherein the active matrix substrate further includes two or more signal lines for respectively transmitting the same control signal to the two or more boost circuit groups.

7. The active matrix substrate according to claim 5, wherein an internal node of one boost circuit of the plurality of boost circuits is connected to control terminals of two or more connection control switching elements to which the same connection control signal is applied among connection control switching elements in the plurality of demultiplexers.

8. The active matrix substrate according to claim 7, wherein the demultiplexing circuit receives a demultiplexing control signal configured by a plurality of control signals for operating the plurality of boost circuits, and the plurality of boost circuits are grouped into two or more boost circuit groups, to which the same control signal of the plurality of control signals is applied, and wherein the active matrix substrate further includes two or more signal lines for respectively transmitting the same control signal to the two or more boost circuit groups.

9. The active matrix substrate according to claim 1, wherein each of the plurality of boost circuits further includes a boost capacitor, a first input terminal connected to the internal node via the charging/discharging switching element, a second input terminal connected to a control terminal of the charging/discharging switching element, and a third input terminal connected to the internal node via the boost capacitor, and wherein the second input terminal of each of the plurality of boost circuits is connected to an internal node of another boost circuit operated by a control signal different from a control signal for operating the boost circuit.

10. The active matrix substrate according to claim 9, wherein each of the plurality of boost circuits further includes a transistor of a diode-connected form, and wherein the internal node in each of the plurality of boost circuits is connected to the first input terminal via the transistor of the diode-connected form.

11. The active matrix substrate according to claim 1, wherein each switching element and transistor included in the demultiplexing circuit is a thin film transistor having a channel layer formed of an oxide semiconductor.

12. A display device comprising:

an active matrix substrate;

a source drive circuit that drives the plurality of data signal lines via the demultiplexing circuit;

a scan signal line drive circuit that drives the plurality of scan signal lines; and a display control circuit that controls the scan signal line drive circuit, the source drive circuit, and the demultiplexing circuit such that a plurality of data signals representing an image to be displayed are applied to the plurality of data signal lines in response to scan of the plurality of scan signal lines, wherein the active matrix substrate includes:

a plurality of data signal lines;

a plurality of scan signal lines intersecting the plurality of data signal lines;

a plurality of pixel formation portions arranged along the plurality of data signal lines and the plurality of scan signal lines; and a demultiplexing circuit that includes a plurality of demultiplexers respectively corresponding to a plurality of sets of data signal lines obtained by grouping the plurality of data signal lines, each set including two or more data signal lines, and includes a plurality of input terminals respectively corresponding to the plurality of demultiplexers, each of the plurality of demultiplexers includes two or more connection control switching elements respectively corresponding to the two or more data signal lines in a corresponding set that is one of the plurality of sets of data signal lines and corresponds to the each of the plurality of demultiplexers, in each of the plurality of demultiplexers, first conduction terminals of the two or more connection control switching elements are all connected to corresponding input terminals, and second conduction terminals of the two or more connection control switching elements are respectively connected to the two or more data signal lines of the corresponding set, the demultiplexing circuit includes a plurality of boost circuits that generate connection control signals to be applied to control terminals of the connection control switching elements included in the plurality of demultiplexers, each of the plurality of boost circuits:

includes an internal node connected to a control terminal of a connection control switching element to which a connection control signal to be generated is applied, and a charging/discharging switching element for charging and discharging the internal node, and is configured to boost a voltage applied to the internal node via the charging/discharging switching element and to apply, as the connection control signal, a boosted voltage of the internal node to the control terminal of the connection control switching element, and the demultiplexing circuit is configured such that, when a charging/discharging switching element in any of the plurality of boost circuits is switched on, a boosted voltage of an internal node in another boost circuit is applied to a control terminal of the charging/discharging switching element.

13. The display device according to claim 12, wherein the display control circuit controls the demultiplexing circuit such that a voltage of the internal node is boosted by any of the plurality of boost circuits at least once before a drive of the plurality of scan signal lines starts from a state where a drive of the plurality of data signal lines and a drive of the plurality of scan signal lines stop.

14. The display device according to claim 12, wherein the display control circuit controls the demultiplexing circuit such that a voltage of the internal node is boosted by any of the plurality of boost circuits at least once before a drive of the plurality of scan signal lines restarts from a state where a drive of the plurality of data signal lines and a drive of the plurality of scan signal lines are halted.

15. A drive method of a display device including an active matrix substrate including a plurality of data signal lines, a plurality of scan signal lines intersecting the plurality of data signal lines, a plurality of pixel formation portions arranged along the plurality of data signal lines and the plurality of scan signal lines, and a demultiplexing circuit that includes a plurality of demultiplexers respectively corresponding to a plurality of sets of data signal lines obtained by grouping the plurality of data signal lines, each set including two or more data signal lines, and includes a plurality of input terminals respectively corresponding to the plurality of demultiplexers, in which each of the plurality of demultiplexers includes two or more connection control switching elements respectively corresponding to the two or more data signal lines in a corresponding set that is one of the plurality of sets of data signal lines and corresponds to the each of the plurality of demultiplexers, in each of the plurality of demultiplexers, first conduction terminals of the two or more connection control switching elements are all connected to corresponding input terminals, and second conduction terminals of the two or more connection control switching elements are respectively connected to the two or more data signal lines of the corresponding set, the demultiplexing circuit includes a plurality of boost circuits that generate connection control signals to be applied to control terminals of the connection control switching elements included in the plurality of demultiplexers, and each of the plurality of boost circuits includes an internal node connected to a control terminal of a connection control switching element to which a connection control signal to be generated is applied, and a charging/discharging switching element for charging and discharging the internal node, the drive method comprising:

a demultiplexing step of demultiplexing multiplexed data signals applied to input terminals corresponding to each of the plurality of demultiplexers to generate two or more data signals to be respectively applied to the two or more data signal lines of the corresponding set, wherein the demultiplexing step includes:

a charging step of precharging the internal node in each of the plurality of boost circuits via the charging/discharging switching element in response to a demultiplexing control signal applied to the demultiplexing circuit, and a boost step of boosting a voltage of the internal node in response to the demultiplexing control signal after precharging is performed by the charging step in each of the plurality of boost circuits, and in the charging step, a boosted voltage of an internal node in another boost circuit is applied to a control terminal of the charging/discharging switching element included in each of the plurality of boost circuits.

* * * * *